US007539455B2

(12) United States Patent
Takiguchi et al.

(10) Patent No.: US 7,539,455 B2
(45) Date of Patent: May 26, 2009

(54) IMAGE FORMING APPARATUS

(75) Inventors: Toshiki Takiguchi, Yamatokoriyama (JP); Kouji Wakamoto, Kitakatsuragi-gun (JP); Tatsuya Inoue, Nara (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 528 days.

(21) Appl. No.: 11/325,352

(22) Filed: Jan. 5, 2006

(65) Prior Publication Data

US 2006/0159498 A1 Jul. 20, 2006

(30) Foreign Application Priority Data

Jan. 19, 2005 (JP) ..... 2005-012061

(51) Int. Cl.
*G03G 15/00* (2006.01)

(52) U.S. Cl. ..... 399/396; 399/394

(58) Field of Classification Search ..... 399/396, 399/394

See application file for complete search history.

(56) References Cited

U.S. PATENT DOCUMENTS 4,972,209 A * 11/1990 Tanigawa ..... 347/252
5,319,470 A * 6/1994 Shukunami ..... 358/451
5,450,170 A * 9/1995 Kimizuka et al. ..... 399/18
6,173,088 B1 * 1/2001 Koh et al. ..... 382/289
6,674,508 B2 * 1/2004 Ando et al. ..... 355/40
6,738,596 B2 * 5/2004 Kamimura et al. ..... 399/396
6,766,124 B2 * 7/2004 Taguchi et al. ..... 399/66

FOREIGN PATENT DOCUMENTS

JP 3-101769 A 4/1991
JP 9-68874 A 3/1997
JP 2001-13841 A 1/2001

* cited by examiner

*Primary Examiner*—Anthony H. Nguyen
(74) *Attorney, Agent, or Firm*—Nixon & Vanderhye, PC

(57) ABSTRACT

An image forming apparatus of the present invention carries out an image processing with respect to image information which is to be printed. The image forming apparatus predicts the occurrence of an image elongation which may occur due to slippage of a recording material with respect to the electrostatic image drum, and specifies an image elongation occurring area on the basis of a printing ratio of the image information. If the occurrence of slippage, and thus image elongation is predicted, the amount of the image elongation occurring area to be shortened is calculated. The image information is then modified to obtain write image information that is shortened based on the calculated shortening amount. This write image information is then used to form the electrostatic latent image that is developed and transferred to a recording material. Thus, even slippage does occur, it is possible to accurately form the desired image on the recording material.

8 Claims, 13 Drawing Sheets

| | PRINTING RATIO | | | |
|---|---|---|---|---|
| | FROM 0 % TO 40 % | FROM MORE THAN 40 % TO 60 % | FROM MORE THAN 60 % TO 80 % | FROM MORE THAN 80 % TO 100 % |
| SLIPPING RATIO (%) | 0.0 | 0.238 | 0.476 | 0.714 |

FIG. 9

| | PRINTING RATIO | | | |
|---|---|---|---|---|
| | FROM 0 % TO 20 % | FROM MORE THAN 20 % TO 55 % | FROM MORE THAN 55 % TO 70 % | FROM MORE THAN 70 % TO 100 % |
| SLIPPING RATIO (%) | 0.0 | 0.238 | 0.476 | 0.714 |

FIG. 10

| | PRINTING RATIO | | | |
|---|---|---|---|---|
| | FROM 0 % TO 30 % | FROM MORE THAN 30 % TO 50 % | FROM MORE THAN 50 % TO 70 % | FROM MORE THAN 70 % TO 100 % |
| SLIPPING RATIO (%) | 0.0 | 0.238 | 0.476 | 0.714 |

FIG. 11

| | PRINTING RATIO | | | |
|---|---|---|---|---|
| | FROM 0 % TO 40 % | FROM MORE THAN 40 % TO 75 % | FROM MORE THAN 75 % TO 95 % | FROM MORE THAN 95 % TO 100 % |
| SLIPPING RATIO (%) | 0.0 | 0.238 | 0.476 | 0.714 |

FIG. 12

| | PRINTING RATIO | | | |
|---|---|---|---|---|
| | FROM 0 % TO 55 % | FROM MORE THAN 55 % TO 70 % | FROM MORE THAN 70 % TO 90 % | FROM MORE THAN 90 % TO 100 % |
| SLIPPING RATIO (%) | 0.0 | 0.238 | 0.476 | 0.714 |

FIG. 13 (a)

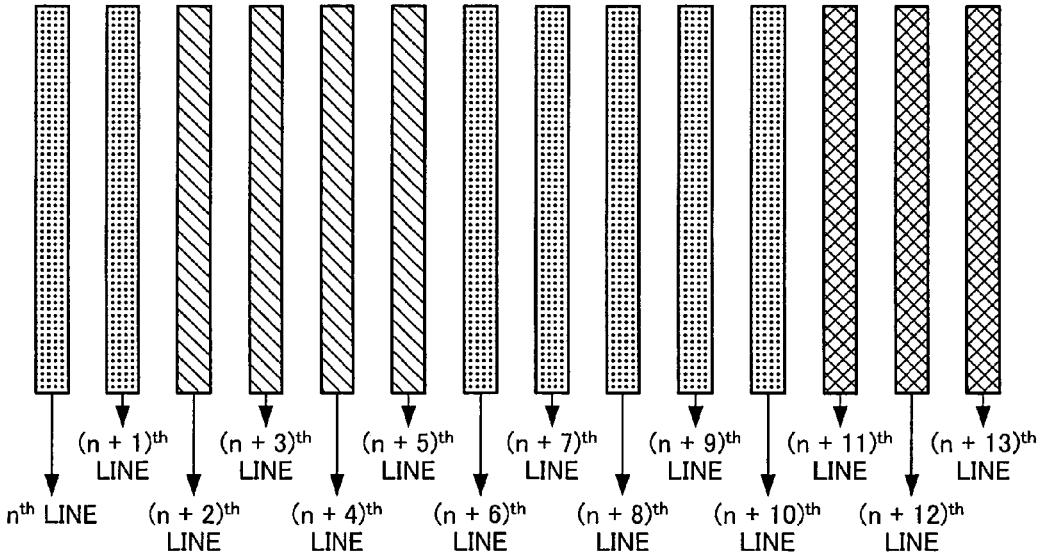

FIG. 13 (b)

| LINES | CAN LINE BE THINNED OUT? | REASON FOR YES OR NO |
|---|---|---|
| $n^{th}$ LINE | NO | BECAUSE $(n - 1)^{th}$ LINE IS UNKNOWN |
| $(n + 1)^{th}$ LINE | NO | BECAUSE $(n + 2)^{th}$ LINE HAS DIFFERENT PRINTING RATIO |
| $(n + 2)^{th}$ LINE | NO | BECAUSE $(n + 1)^{th}$ LINE HAS DIFFERENT PRINTING RATIO |
| $(n + 3)^{th}$ LINE | YES | BECAUSE $(n + 3)^{th}$ LINE HAS SAME PRINTING RATIO AS $(n + 2)^{th}$ LINE AND $(n + 4)^{th}$ LINE |
| $(n + 4)^{th}$ LINE | NO | BECAUSE PRINT IMAGE WILL BE SHORTENED TOO MUCH IF TWO CONSECUTIVE LINES ARE THINNED OUT |
| $(n + 5)^{th}$ LINE | NO | BECAUSE $(n + 6)^{th}$ LINE HAS DIFFERENT PRINTING RATIO |
| $(n + 6)^{th}$ LINE | NO | BECAUSE $(n + 5)^{th}$ LINE HAS DIFFERENT PRINTING RATIO |
| $(n + 7)^{th}$ LINE | YES | BECAUSE $(n + 7)^{th}$ LINE HAS SAME PRINTING RATIO AS $(n + 6)^{th}$ LINE AND $(n + 8)^{th}$ LINE |
| $(n + 8)^{th}$ LINE | NO | BECAUSE PRINT IMAGE WILL BE SHORTENED TOO MUCH IF TWO CONSECUTIVE LINES ARE THINNED OUT |
| $(n + 9)^{th}$ LINE | YES | BECAUSE $(n + 9)^{th}$ LINE HAS SAME PRINTING RATIO AS $(n + 8)^{th}$ LINE AND $(n + 10)^{th}$ LINE |
| $(n + 10)^{th}$ LINE | NO | BECAUSE $(n + 11)^{th}$ LINE HAS DIFFERENT PRINTING RATIO |
| $(n + 11)^{th}$ LINE | NO | BECAUSE $(n + 10)^{th}$ LINE HAS DIFFERENT PRINTING RATIO |
| $(n + 12)^{th}$ LINE | NO | ALTHOUGH $(n + 12)^{th}$ LINE IS LINE TO BE THINNED OUT, $(n + 12)^{th}$ LINE IS NOT THINNED OUT DUE TO ADJUSTMENT OF MAGNIFICATION OF PRINT IMAGE |
| $(n + 13)^{th}$ LINE | NO | BECAUSE $(n + 14)^{th}$ LINE IS UNKNOWN |

IMAGE FORMING APPARATUS

This Nonprovisional application claims priority under 35 U.S.C. § 119(a) on Patent Application No. 12061/2005 filed in Japan on Jan. 19, 2005, the entire contents of which are hereby incorporated by reference.

FIELD OF THE TECHNOLOGY

The present technology relates to an image forming apparatus which visualizes an electrostatic latent image formed on an electrostatic latent image bearing member, so as to form a visible image, and then transfers the visible image to a recording material while conveying the recording material.

BACKGROUND OF THE TECHNOLOGY

An image forming apparatus causes a writing device to form on a photoreceptor (electrostatic latent image bearing member) an electrostatic latent image based on image information, and visualizes the electrostatic latent image with a toner (developer) so as to form a toner image (visible image). Then, a transfer device transfers the toner image from the photoreceptor to a sheet that is a recording material.

In the case in which the transfer device is a transfer roller, the toner image is transferred to the sheet by (i) supplying the sheet to a transfer nip portion where the photoreceptor and the transfer roller are compressed against each other, and (ii) conveying the sheet (recording material) by rotational forces of the photoreceptor and the transfer roller. Because a transfer voltage is applied to the transfer roller, the sheet passing through the transfer nip portion is electrically charged by the transfer voltage. Therefore, the toner on the photoreceptor is absorbed by the sheet.

Incidentally, a peripheral velocity of the transfer roller is higher than that of the photoreceptor. Therefore, the sheet once sticks to the photoreceptor, but is pulled due to the difference in peripheral velocity between the photoreceptor and the transfer roller. Thus, the sheet is separated from the photoreceptor. This arrangement is made to avoid deterioration in printing quality, such as hollow characters and half-tone thin dots caused due to a separation discharge generated when the sheet is separated from the transfer nip portion.

That is, the transfer voltage is applied to the transfer roller to transfer the toner to the sheet, however it is no exaggeration to say that a portion where the transfer voltage works normally is the transfer nip portion. Therefore, a white portion (that is, a portion on which the toner is not deposited) on the surface (close to the photoreceptor) of the sheet at the transfer nip portion is electrically charged with a high potential. On this account, when the sheet is separated from the transfer nip portion, the separation discharge is generated between the white portion of the sheet and a high potential portion on the photoreceptor. Due to the separation discharge, some of the toner transferred to the sheet is reversely transferred to the photoreceptor. This causes the above-described deterioration in printing quality.

In front of the transfer nip portion, a sheet conveying roller, called an idle roller, is provided. The sheet conveying roller rotates at substantially the same peripheral velocity as the transfer roller. As shown in FIGS. 17(*a*) to 17(*d*), a sheet P conveyed by an idle roller 116 is conveyed to a contact point of a transfer nip portion 127 in such a direction that the front edge of the sheet P proceeds toward an outer circumference of the photoreceptor 121. After the front edge of the sheet P first contacts with the photoreceptor 121, the sheet P is conveyed to the transfer nip portion 127 by the rotation of the photoreceptor 121.

If the front edge of the sheet P directly contacts with the contact point of the transfer nip portion 127, the sheet P vibrates at the moment of the front edge of the sheet P entering to the transfer nip portion 127. This vibration may cause a print slur (image deviation, transfer deviation) and/or a paper cockle at the front edge of the sheet P.

Further, in front of the transfer nip portion 127, a bended portion 128 of the sheet P is formed as shown in FIG. 17(*d*). The bended portion 128 is formed by substantially equalizing the peripheral velocity of the idle roller 116 and the peripheral velocity of a transfer roller 125. By forming the bended portion 128 in front of the transfer nip portion 127, the sheet P is conveyed to the transfer nip portion 127 in a state in which the sheet P surely sticks to the surface of the photoreceptor 121. Therefore, it is possible to prevent the problem in which, before the sheet P reaches the transfer nip portion 127, the sheet P sticks to the surface of the transfer roller 125 so as to be charged unnecessarily. Excessive charge to the sheet causes the above-described phenomenon of reversely transferring the toner.

By the bended portion 128 which intends to be flat, the sheet P is pushed in a direction in which the sheet P is conveyed. Therefore, the amount of the bended portion 128 is adjusted so that slipping of the sheet P is avoided by a nip pressure of the transfer nip portion 127.

Moreover, in recent years, a particle diameter of the toner for visualizing the electrostatic latent image has been reduced due to an increase in resolution of the image information. Conventionally, the particle diameter of the toner is substantially in a range from 8 Φμm to 12 Φμm. However, in recent years, the particle diameter of the toner is substantially in a range from 4 Φμm to 7 Φμm. In the case of a small-particle toner used in recent years, even if large particles and fine particles are removed in a manufacturing step, crushing occurs due to friction at the time of frictional electrification that is the application of electric charge to the toner. Therefore, the toner whose particle diameter is 2 Φμm or less also contributes to an image development.

Conventionally, the image forming apparatus forcibly omits a signal corresponding to a sheet peripheral edge portion determined by the image forming apparatus, from an image signal supplied from a terminal device such as a host computer, so as to form a blank space.

If the above omission is not carried out in the case of recording on the entire sheet the image based on the image signal supplied from the terminal device, the toner corresponding to the sheet peripheral edge portion of the toner image on the photoreceptor is not transferred, and the toner remains on the photoreceptor. Then, the remaining toner scatters inside the image forming apparatus. This causes deterioration in image quality and/or a jam.

With regard to such a technique for forcibly forming the blank space, for example, Japanese Unexamined Patent Publication No. 101769/1991 (Tokukaihei 3-101769, published on Apr. 26, 1991) discloses a technique for separately changing the size of each blank space corresponding to each edge of a sheet when images are formed on the same sheet twice. Even if an error in a tolerance range occurs, an image can be prevented from sticking out, and it is possible to increase a region which can be utilized effectively for image formation.

Moreover, Japanese Unexamined Patent Publication No. 068874/1997 (Tokukaihei 9-068874, published on Mar. 11, 1997) discloses a technique in which, after a first test pattern (a solid image having a small blank space at a rear edge) is outputted and an image whose rear edge portion is blurred is obtained, a second test pattern having a normal blank space at a rear edge is outputted and the blank space at the rear edge is adjusted so as to correct the blur at the rear edge portion of the image. With this, it is possible to prevent the damage caused by the transfer charge (transfer electric field) to the image carrier (photoreceptor), and also possible to obtain the image of high quality.

However, since the particle diameter of the toner has been reduced these days, there occur problems which had not occurred in the past. That is, the problem is a phenomenon in which the rear edge of the image formed on the sheet moves backward, that is, the image is lengthened on the sheet. In a terrible case, the blank space provided at the sheet rear edge portion completely disappears. This phenomenon relates to a printing ratio on the sheet, and occurs in the case in which the printing ratio is high.

As a result of studies for finding out the cause of the above-described phenomenon, the present inventors found that the phenomenon is caused by a phenomenon in which the sheet slips with respect to the photoreceptor at the transfer nip portion. The present inventors further found that this slipping is caused by a combination of the following factors: (i) a decrease in particle diameter of the toner, (ii) the difference in peripheral velocity between the photoreceptor and the transfer roller and (iii) the bended portion formed in front of the transfer nip portion.

That is, in the case in which the amount of toner between the sheet and the photoreceptor is large, the absorptive power between the sheet and the photoreceptor decreases due to the decrease in particle diameter of the toner. Because of the decrease in the absorptive power, the nip pressure of the transfer nip portion cannot overcome the pushing power generated by the bended portion formed in front of the transfer nip portion. Therefore, the sheet moves in accordance with the peripheral velocity of the transfer roller. As a result, the sheet slips with respect to the photoreceptor.

The following will explain a mechanism of the decrease in the absorptive power between the sheet and the photoreceptor in reference to FIGS. 16(*a*) and 16(*b*). FIGS. 16(*a*) and 16(*b*) show the transfer nip portion where the toner image is transferred. A conventional large-particle toner T is used in FIG. 16(*a*), and a small-particle toner t of today is used in FIG. 16(*b*).

At the transfer nip portion 127, the photoreceptor 121 and the transfer roller 125 are compressed against each other via the toner (T, t) and a sheet P in this order when viewed from the photoreceptor 121, and a transfer voltage is applied by a transfer voltage applying section 129 through the transfer roller 125. The sheet P is conveyed in a sheet conveyance direction (indicated by an arrow X) by the rotational forces of the photoreceptor 121 and the transfer roller 125. Note that in FIGS. 16(*a*) and 16(*b*), an arrow Y indicates a rotation direction of the photoreceptor 121 and an arrow Z indicates a rotation direction of the transfer roller 125.

By applying the transfer electric field from the transfer roller 125 through the sheet P to the toner on the photoreceptor 121, the toner is absorbed by the sheet P. However, even in the case in which the thickness of a toner layer in FIG. 16(*a*) is the same as that in FIG. 16(*b*), an air layer in the toner layer made by the small-particle toner t is larger than an air layer in the toner layer made by the large-particle toner T.

Therefore, in the photoreceptor, the toner, the sheet and the transfer roller, the distance of propagation of the electric field is longer in the toner layer of the small-particle toner t than in the toner layer of the large-particle toner T. In the case in which the distance of propagation is long, the intensity of the electric field (electric field intensity) becomes low when the electric field propagates the toner layer and reaches the photoreceptor 121. As a result, the absorptive power between the sheet P and the photoreceptor 121 decreases.

Since the absorptive power between the sheet P and the photoreceptor decreases, the phenomenon of slipping of the sheet with respect to the photoreceptor occurs by the pushing power of the bended portion formed in front of the transfer nip portion. As a result, the phenomenon of backward movement of the rear edge of the image transferred to the sheet P occurs.

In the case in which the rear edge of the image moves backward and the blank space provided at the rear edge portion of the sheet completely disappears, there are problems in that the remaining toner on the photoreceptor causes printing stain when printing an image on the following sheet(s) and the printing quality (image quality) deteriorates because of no blank space. In addition to these, in a compact image forming apparatus which employs a switchback conveyance method and is capable of carrying out two-side printing, the sheet winds around a fixing roller and the jam occurs.

In the switchback conveyance method, a front edge and a rear edge reverse between when printing on a first surface and when printing on a second surface. That is, the rear edge portion of the first surface becomes the front edge portion of the second surface. In the case in which the blank space at the front edge portion disappears, the sheet is conveyed to a fixing process that is the next process of the transfer process and the unfixed toner is molten and fixed, the molten toner sticks to the fixing roller, the sheet winds around the fixing roller and the jam occurs.

This problem occurs since the particle diameter of the toner has been reduced. Therefore, this problem is a new problem which had not been considered in the past. Since the techniques disclosed in the above-described Japanese Unexamined Patent Publication Nos. 101769/1991 and No. 068874/1997 do not consider the problem, those techniques, of course, cannot solve the problem.

SUMMARY OF THE TECHNOLOGY

An object of the present technology is to provide an image forming apparatus which can secure a blank space at a rear edge portion of a sheet even if a phenomenon of slipping of the sheet with respect to a photoreceptor occurs and can express an original image on the sheet without cutting an image at the rear edge portion of the sheet in order to secure the blank space at the rear edge portion of the sheet.

In order to achieve the above object, an image forming apparatus of the present technology forms on an electrostatic latent image bearing member an electrostatic latent image based on image information, visualizes the electrostatic latent image by a developer so as to obtain a visible image, and causes a transfer device to transfer the visible image to a recording material at a transfer nip portion while conveying the recording material, and the image forming apparatus includes: image elongation predicting means for predicting the occurrence of an image elongation, in other words, predicting that, due to slipping of the recording material with respect to the electrostatic latent image bearing member at the transfer nip portion, the visible image transferred is lengthened in a direction in which the recording material is conveyed; image elongation occurring area specifying means for specifying an image elongation occurring area of the electrostatic latent image, the image elongation occurring area being an area having such a possibility that the image elongation occurs; and image elongation correcting means for, if the image elongation predicting means predicts that the image elongation occurs, shortening the image elongation occurring area of the electrostatic latent image in the direction in which the recording material is conveyed, the image elongation occurring area being specified by the image elongation occurring area specifying means.

According to the above, the image elongation predicting means predicts the occurrence of the image elongation, in other words, predicts that, due to the slipping of the recording material with respect to the electrostatic latent image bearing member at the transfer nip portion, the visible image transferred is lengthened in the direction in which the recording material is conveyed, and the image elongation occurring area specifying means specifies the image elongation occurring area. In the case in which the image elongation predicting means predicts the occurrence of the image elongation, (i) the image elongation correcting means shortens in the direction in which the recording material is conveyed, the image elongation occurring area of the electrostatic latent image to be formed on the electrostatic latent image bearing member, (ii) the electrostatic latent image whose image elongation occurring area is shortened in advance in the direction in which the recording material is conveyed is formed on the electrostatic latent image bearing member and (iii) this electrostatic latent image is developed and becomes the visible image.

Therefore, even if the slip phenomenon occurs, that is, the phenomenon of slipping of the recording material with respect to the electrostatic latent image bearing member at the transfer nip portion occurs, and the visible image transferred to the recording material is lengthened on the recording material, the blank space at the rear edge portion of the recording material is secured since the visible image itself formed on the electrostatic latent image bearing member is being shortened.

As a result, it is possible to appropriately avoid the problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

In addition, with regard to a shortening of the electrostatic latent image, the image elongation occurring area of the electrostatic latent image is shortened here. Therefore, it is possible to express the image on the recording material, without cutting the image at the rear edge portion of the recording material in order to secure the blank space at the rear edge portion of the recording material.

The image forming apparatus of the present technology further includes shortening amount setting means for setting the amount of the image elongation occurring area to be shortened, the amount being set on the basis of the amount of the visible image lengthened due to the image elongation, and the image elongation correcting means shortens the image elongation occurring area of the electrostatic latent image on the basis of the amount set by the shortening amount setting means.

According to the above, the shortening amount setting means sets the amount of the image elongation occurring area to be shortened, the amount being set on the basis of the amount of the visible image lengthened due to the image elongation, and the image elongation correcting means shortens the image elongation occurring area of the electrostatic latent image on the basis of the amount set by the shortening amount setting means.

Therefore, it is possible to secure the default amount of the blank space at the rear edge portion of the recording material, and also possible to express the original image based on the image information and having no image elongation, as if no image elongation had occurred.

Additional objects, features, and strengths will be made clear by the description below. Further, the advantages will be evident from the following explanation in reference to the drawings.

BRIEF DESCRIPTION OF THE DRAWINGS

FIG. 9 is an explanatory diagram showing another relation between the slipping ratio and the printing ratio, and the relation is used for, for example, predicting the occurrence of the image elongation.

FIG. 10 is an explanatory diagram showing yet another relation between the slipping ratio and the printing ratio, and the relation is used for, for example, predicting the occurrence of the image elongation.

FIG. 11 is an explanatory diagram showing still another relation between the slipping ratio and the printing ratio, and the relation is used for, for example, predicting the occurrence of the image elongation.

FIG. 12 is an explanatory diagram showing still another relation between the slipping ratio and the printing ratio, and the relation is used for, for example, predicting the occurrence of the image elongation.

FIGS. 13(*a*) and 13(*b*) are explanatory diagrams showing a process of thinning out main scanning lines, and this process is one example of a process of shortening the image elongation occurring area.

DESCRIPTION OF THE EMBODIMENTS

The following will explain one embodiment in reference to FIGS. 1 to 15. Note that the present technology is not limited to this.

Figure 2:
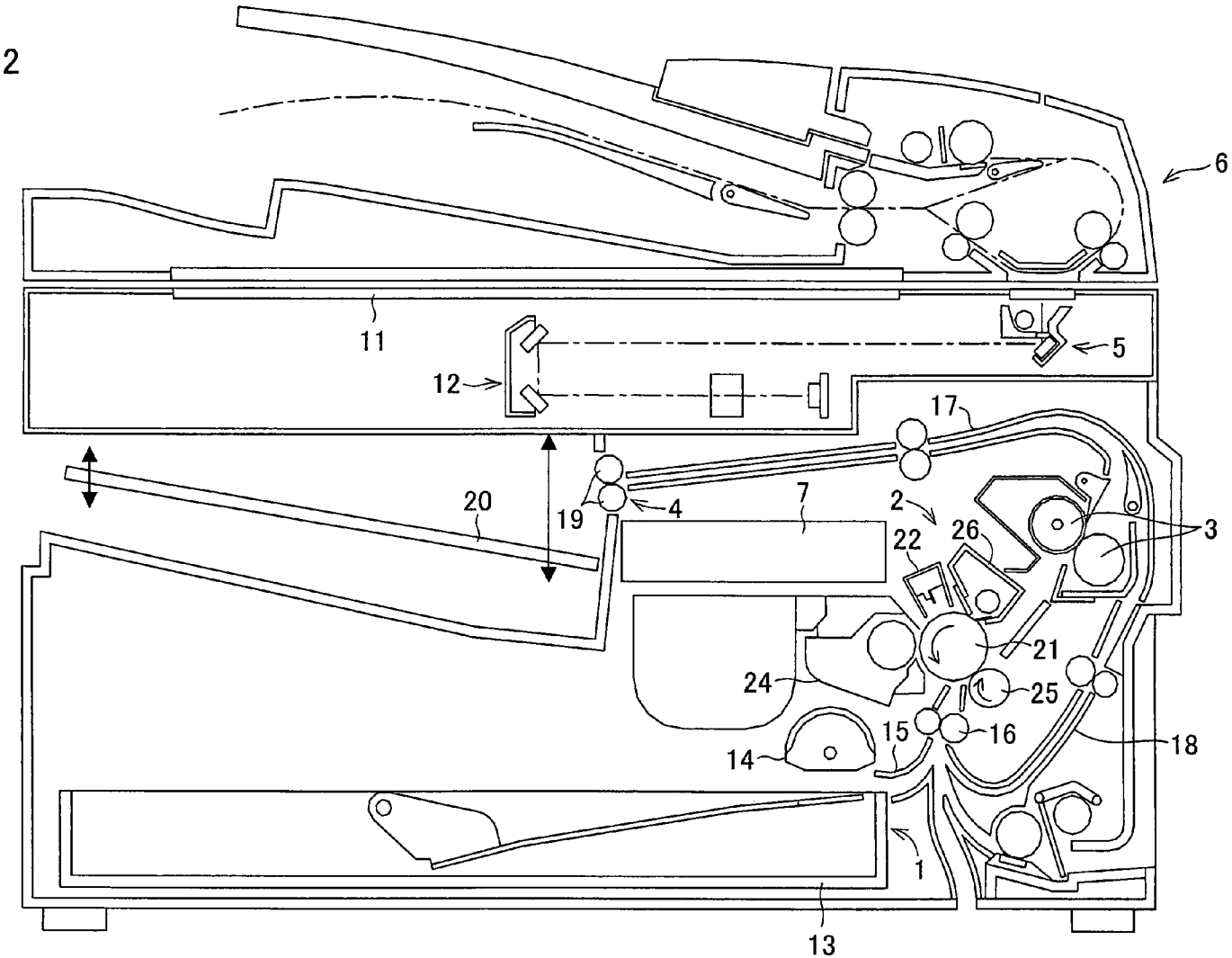
FIG. 2 is a vertical cross-sectional view showing an arrangement of the image forming apparatus.
Figure 3:
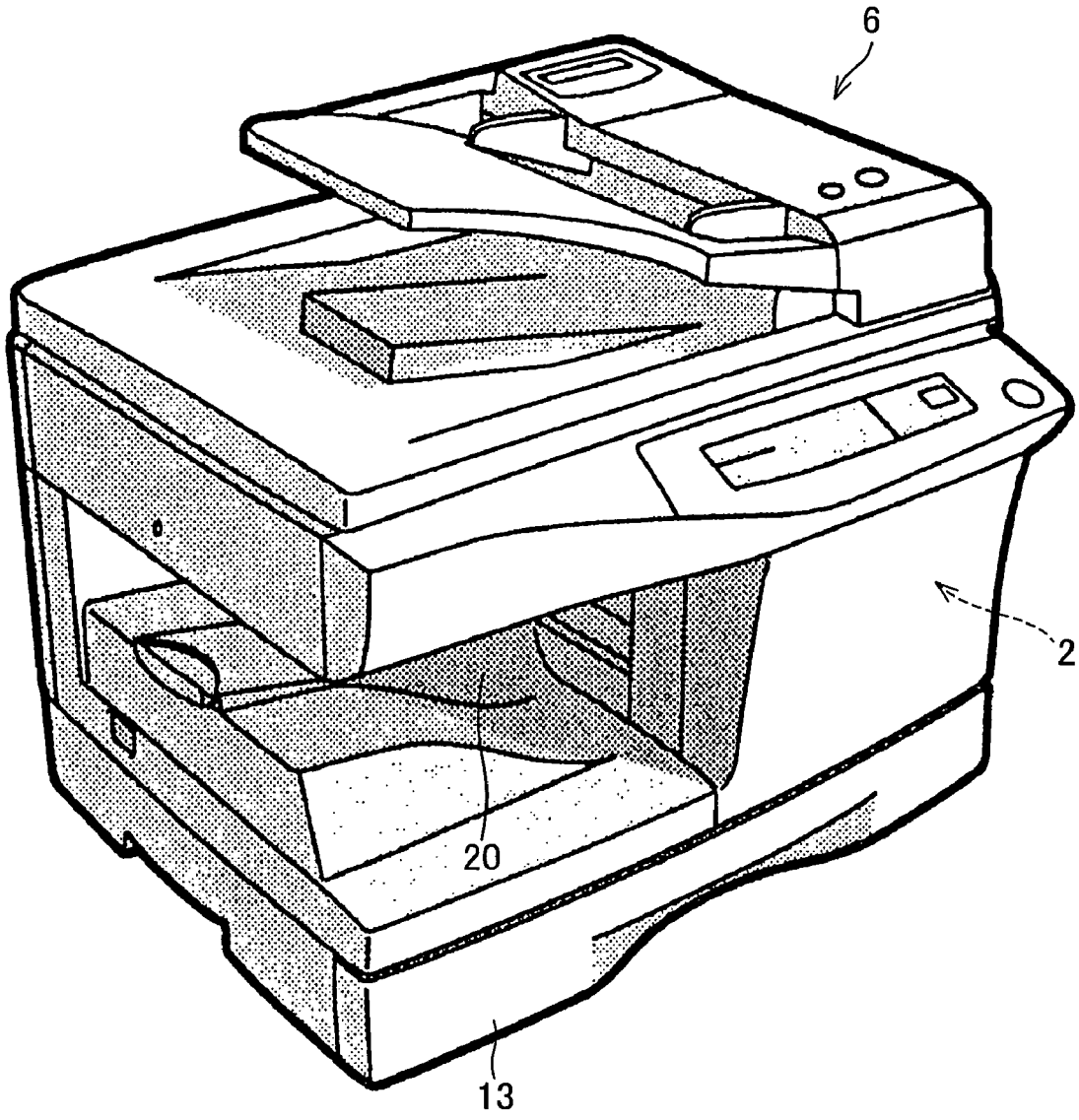
FIG. 3 is a perspective view showing an exterior of the image forming apparatus.
Figure 4:
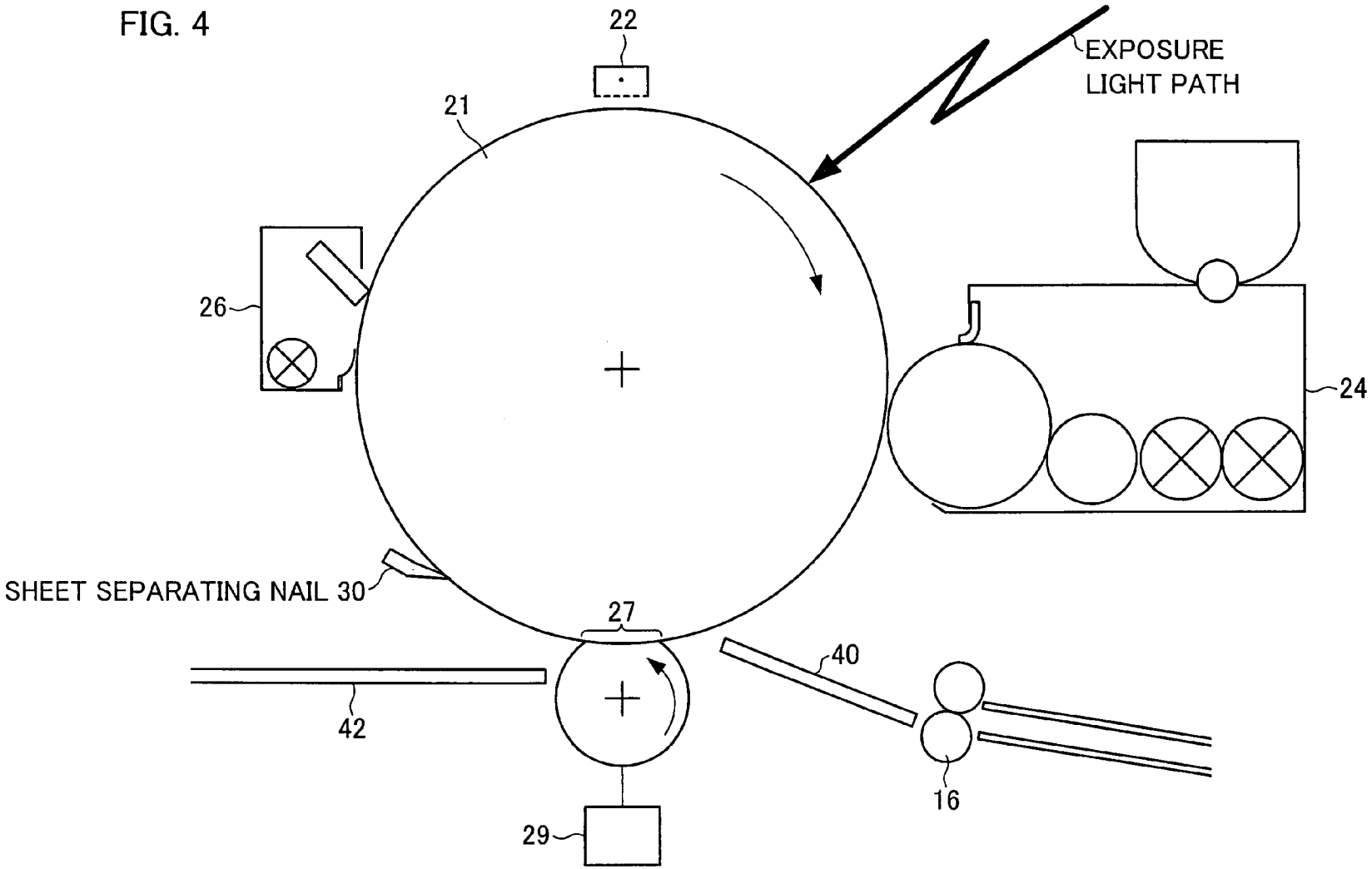
FIG. 4 is an explanatory diagram showing an arrangement of an image forming section of the image forming apparatus.

As shown in FIG. 2 that is a vertical cross-sectional view, an image forming apparatus of the present embodiment includes, along a direction in which a sheet (recording material) is conveyed, a sheet feeding section 1, an image forming section 2, a fixing section 3 and a sheet ejecting section 4, and an image scanning section 5 is provided above these sections. Further, an automatic document conveying device 6 that is an option is provided above the image scanning section 5. FIG. 3 shows an exterior of the present image forming apparatus, and FIG. 4 shows an arrangement of the image forming section 2.

Note that the following description in the present embodiment explains the image forming apparatus which can carry out both a black-and-white one-side printing and a black-and-white two-side printing. However, the present embodiment is not limited to this, and is applicable to a color image forming apparatus.

A document table 11 for mounting a document is provided near the image scanning section 5, and the automatic document conveying device 6 is provided above the document table 11 such that the automatic document conveying device 6 can be opened and closed. The automatic document conveying device 6 also functions as a document cover for preventing the mounted document from floating and for mounting the document in an appropriate place.

Image information of the document mounted on the document table 11 is read by an optical unit 12 provided under the document table 11. The image information read is subjected to an image processing by a control section 7, and is once stored in a memory (not shown) as the image information. Similarly, image information of a document conveyed by the automatic document conveying device 6 is read by the optical unit 12.

In the sheet feeding section 1, a sheet feeding cassette 13 is provided for housing sheets. The sheet in the sheet feeding cassette 13 is conveyed to a conveyance path 15 by the rotation of a sheet feeding roller 14. On the conveyance path 15 and in front of the image forming section 2, an idle roller 16 is provided. The conveyance of the sheet once stops when the front edge of the sheet reaches the idle roller 16. The idle roller 16 stops in order to match the front edge of an image transfer region on the sheet with the front edge of a toner image visualized on a photoreceptor 21 described later.

The image forming section 2 forms on the sheet the toner image based on the image information. As shown in FIG. 4, the image forming section 2 includes the photoreceptor 21 that is in the shape of a cylinder. Further, the image forming section 2 includes, around the photoreceptor 21, a main charging device 22, a laser scanner unit (not shown), a developing device 24, a transfer device including a transfer roller 25, a sheet separating nail 30, a cleaning section 26, etc.

The main charging device 22 applies a certain voltage to the photoreceptor 21 to charge the surface of the photoreceptor 21 at a predetermined potential. The laser scanner unit reads out the image information from the memory of the control section 7, and exposes the photoreceptor 21 with laser light modulated by the image information, so as to form on the photoreceptor 21 an electrostatic latent image based on the image information.

The laser scanner unit forms the electrostatic latent image based on (i) the image information of the document mounted on the document table 11 and read by the image scanning section 5, (ii) the image information of the document which is moving by the auto document conveying device 6 and (iii) image information transmitted from each terminal device on a network (not shown) connected to the present image forming apparatus.

The toner (developer) in the developing device 24 is supplied from a developing roller to the surface of the photoreceptor 21. In this way, the electrostatic latent image formed on the photoreceptor 21 is visualized, that is, the electrostatic latent image becomes a toner image. This visualization is realized in such a manner that the toner is deposited on the surface of the photoreceptor 21 in accordance with a potential contrast of the electrostatic latent image on the photoreceptor 21. A developing bias is applied to the developing roller so that the toner is easily deposited on the photoreceptor 21.

The toner image on the photoreceptor 21 is conveyed toward the transfer roller 25 by the rotation of the photoreceptor 21. Moreover, the idle roller 16 restarts rotating. In this way, the toner image is transferred at an appropriate position on the sheet when the sheet passes through the transfer nip portion 27 where the photoreceptor 21 and the transfer roller 25 are compressed against each other. The transfer voltage is applied from the transfer voltage applying section 29 through the transfer roller 25 to the transfer nip portion 27, and the sheet absorbs the toner by the transfer voltage. Then, the sheet is separated from the photoreceptor 21 by the sheet separating nail 30, and is conveyed to the fixing process by the rotational forces of the photoreceptor 21 and the transfer roller 25. Note that details of the transfer process will be described later.

The toner image transferred to the sheet is conveyed to the fixing section 3 in the next process. The toner image is molten and fixed on the sheet by the heat and pressure of the fixing section 3. Note that the fixing section 3 includes a heating roller and a pressure roller.

The sheet on which the toner image is fixed is conveyed in a conveyance path 17. In the case of the one-side printing, the sheet is ejected through a sheet ejecting roller 19 onto a sheet ejecting tray 20. In the case of the two-side printing, the rear edge portion of the sheet is held by the sheet ejecting roller 19 to once stop the sheet when the sheet passes through the sheet ejecting roller 19. Then, the sheet is conveyed from the conveyance path 17 to a sub conveyance path 18 by reversely rotating the sheet ejecting roller 19.

Such technique of reversely conveying the sheet is generally called a "switchback conveyance", and the sub conveyance path 18 is also referred to as a switchback conveyance path. After the sheet is reversely conveyed and its front surface and back surface are reversed, the sheet again reaches the idle roller 16. The toner image newly visualized by the image forming section 2 on the basis of the image information to be printed on the back surface (second surface) is transferred to and fixed on the back surface of the sheet. Then, the sheet is ejected through the conveyance path 17 and the sheet ejecting roller 19 onto the sheet ejecting tray 20.

Note that the foregoing description explains a general printing procedure of an electrophotographic printing method, and it is clear that a post-processing unit, a paper feeding unit having a plurality of stages for housing various types of sheets, and a paper ejecting tray having a plurality of bins for easily sorting ejected sheets are applicable to the present image forming apparatus in order to realize multi-function.

The following will explain the transfer process in the present image forming apparatus.

Again, in the case of the present image forming apparatus, the peripheral velocity of the transfer roller 25 is higher than that of the photoreceptor 21 due to the above-described reason. Therefore, the sheet is pulled due to the difference in the peripheral velocity between the photoreceptor 21 and the transfer roller 25, so that the sheet is separated from the photoreceptor 21. Note that the peripheral velocity of the idle roller 16 is the same as that of the transfer roller 25.

In the case in which the peripheral velocity of the photoreceptor 21 is V1 (mm/sec), the peripheral velocity of the transfer roller 25 is V2 (mm/sec) and the peripheral velocity of the idle roller 16 is V3 (mm/sec) in the present image forming apparatus, these V1, V2 and V3 are designed so as to satisfy $V1<V2\approx V3$ (that is, $V1<V2=V3$ (V3 ranges from $0.99\times V2$ to $1.012\times V2$)). Here, in order that a bended portion having a predetermined amount is formed in front of the transfer nip portion 27, these V1, V2 and V3 are designed so as to satisfy $V1\times 1.005\leqq V2\approx V3\leqq V1\times 1.03$.

Moreover, the sheet conveyed from the idle roller 16 is conveyed to a contact point of the transfer nip portion 27 in such a direction that the front edge of the sheet proceeds toward an outer circumference of the photoreceptor 21. After the front edge of the sheet first contacts with the photoreceptor 21, the sheet is conveyed to the transfer nip portion 27 by the rotation of the photoreceptor 21.

Figure 5:
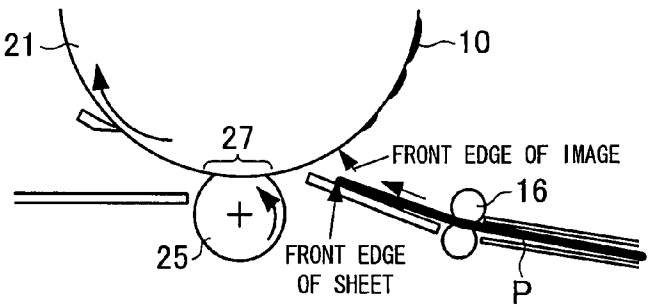
FIGS. 5(*a*) to 5(*e*) are explanatory diagrams showing how a sheet is conveyed to a transfer nip portion of the image forming apparatus.
Figure 5:
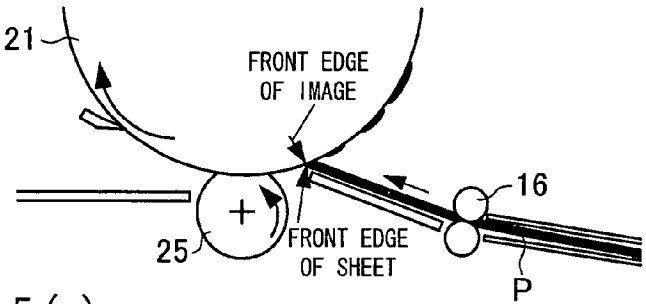
Figure 5:
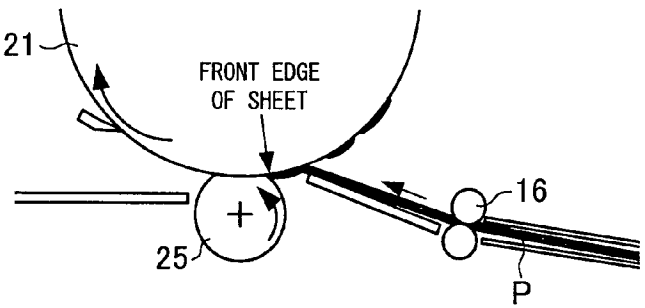
Figure 5:
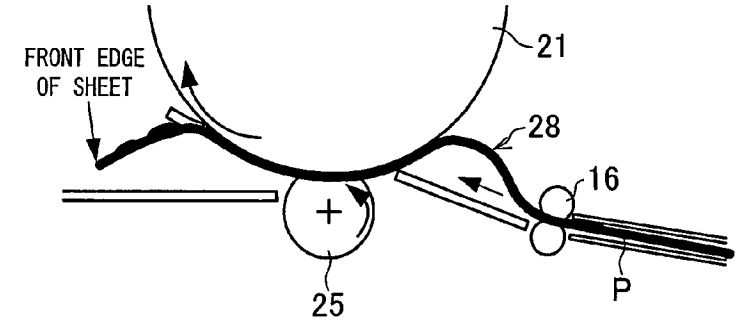
Figure 5:
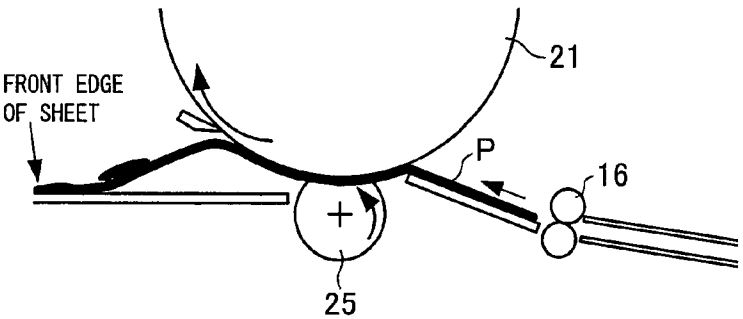

FIGS. 5(*a*) to 5(*e*) show how a sheet P is conveyed to the transfer nip portion 27. The toner image 10 formed on the photoreceptor 21 is conveyed to the transfer nip portion 27 by the rotation of the photoreceptor 21, and the sheet P is conveyed to the transfer nip portion 27 by the rotation of the idle roller 16. The sheet P conveyed from the idle roller 16 is conveyed to the contact point of the transfer nip portion 27 by the guidance of a paper guide 40 in such a direction that the front edge of the sheet P proceeds toward the outer circumference of the photoreceptor 21. Therefore, the sheet P first contacts with the photoreceptor 21. Then, the sheet P is guided to the transfer nip portion 27 by the rotation of the photoreceptor 21. The sheet P and the photoreceptor 21 contact with each other so that the front edge of the toner image 10 and the front edge of a region where on the sheet P the image is formed (that is, the front edge of a region obtained by omitting from the entire region of the sheet a blank space (front edge void) provided at the front edge portion) match with each other by controlling the timing of the restart of the rotation of the idle roller 16.

The sheet P passes through the transfer nip portion 27, and the toner image 10 is transferred onto the sheet 10. The front edge portion of the sheet P is separated from the photoreceptor 21 by the sheet separating nail 30, and the sheet P is conveyed along a paper guide 41. Moreover, as described above, a portion which has not yet passed through the transfer nip portion 27 sequentially passes through the transfer nip portion 27 while forming the bended portion 28 in front of the transfer nip portion 27. After the rear edge of the sheet P finishes passing through the idle roller 16, the bended portion 28 disappears, and the rear edge portion of the sheet P is conveyed along the paper guide 40.

In the image forming apparatus arranged as above, in the case in which a large amount of toner is between the photoreceptor 21 and the sheet P due to the reduction in the particle diameter of the toner, the sheet P slips with respect to the photoreceptor 21 and the rear edge of the toner image transferred onto the sheet moves backward. Thus, the blank space provided at the rear edge portion of the sheet P reduces or disappears. Therefore, the toner remaining on the photoreceptor 21 causes stain, and the printing quality (image quality) deteriorates because of no blank space. In addition to these, in the case of the present image forming apparatus adopting the switchback conveyance method, there are problems in that for example, when printing onto the second surface for the two-side printing, the jam occurs at the fixing section 3.

In order to prevent the reduction or disappearance of the blank space at the rear edge portion of the sheet P, the following countermeasures are taken in the present image forming apparatus. Note that in the following description, the blank space provided forcibly at the peripheral edge potion of the sheet is referred to as a void. In addition, the blank spaces provided at the rear edge portion, the front edge portion, the left edge portion and the right edge portion of the sheet P are referred to as a rear edge void, a front edge void, a left edge void and a right edge void, respectively.

The present image forming apparatus includes (i) an image elongation predicting section (image elongation predicting means) for predicting the occurrence of an image elongation, in other words, predicting that, due to slipping of the sheet P with respect to the photoreceptor 21 at the transfer nip portion 27, the toner image transferred is lengthened on the sheet P, (ii) an image elongation occurring area specifying section (image elongation occurring area specifying means) for specifying an area (hereinafter referred to as "image elongation occurring area") of the electrostatic latent image, the area being an area having such a possibility that the image elongation occurs and (iii) an image elongation correcting section (image elongation correcting means) for, if the image elongation predicting section predicts the occurrence of the image elongation, shortening the image elongation occurring area of the electrostatic latent image in the direction in which the sheet is conveyed, the image elongation occurring area being specified by the image elongation occurring area specifying section.

According to the above, the image elongation predicting section predicts the occurrence of the image elongation, that is, predicts that the toner image is lengthened on the sheet P when the image is transferred to the sheet P, and the image elongation occurring area specifying section specifies the image elongation occurring area. In the case in which the image elongation predicting section predicts the occurrence of the image elongation, the image elongation correcting section shortens in the direction in which the sheet is conveyed, the image elongation occurring area of the electrostatic latent image formed on the photoreceptor 21. Then, the electrostatic latent image whose image elongation occurring area is shortened in the direction in which the sheet is conveyed is formed on the photoreceptor 21. This electrostatic latent image is developed and becomes a toner image.

Therefore, even if the phenomenon of slipping of the sheet P with respect to the photoreceptor 21 at the transfer nip portion 27 occurs and the toner image transferred is lengthened on the sheet P, it is possible to secure the rear edge void and also possible to appropriately avoid the above-described problems caused due to the reduction or disappearance of the rear edge void since the toner image itself formed on the photoreceptor 21 is shortened.

Further, it is not necessary to cut the image at the rear edge portion in order to secure the blank space at the rear edge portion. In order to shorten the electrostatic latent image in the direction in which the sheet is conveyed, the image elongation occurring area of the electrostatic latent image is shortened. Therefore, the original image can be entirely expressed on the sheet P.

The present image forming apparatus further includes a shortening amount setting section (shortening amount setting means) for setting the amount of the image elongation occurring area to be shortened, the amount being set on the basis of the amount of the visible image lengthened due to the image elongation, and the image elongation correcting section shortens the image elongation occurring area of the electrostatic latent image on the basis of the amount of the image elongation occurring area to be shortened, the amount being set by the shortening amount setting section.

Therefore, the amount of the image elongation occurring area to be shortened by the image elongation correcting section is determined in accordance with the amount of the toner image lengthened on the sheet P due to the image elongation, the amount being set by the shortening amount setting section. Therefore, it is possible to secure the default amount (size) of the rear edge void, and also possible to express the original image on the sheet P on the basis of the image information as if no image elongation had occurred.

Figure 1:
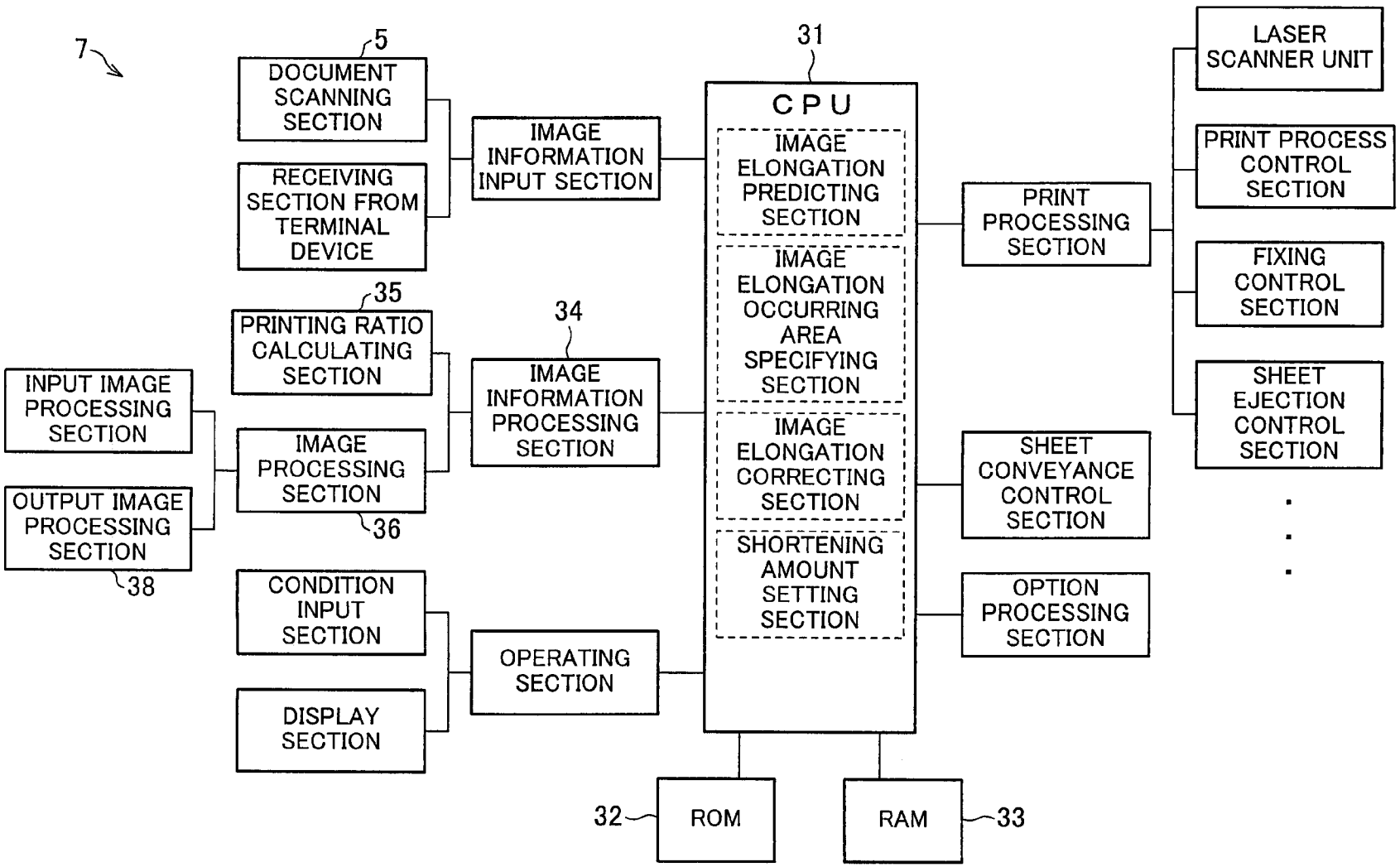
FIG. 1 shows a block diagram of an arrangement of a control section of an image forming apparatus.

Incidentally, the image elongation predicting section, the image elongation occurring area specifying section, the image elongation correcting section and the shortening amount setting section are realized by a CPU 31, a ROM 32, a RAM 33 and an image information processing section 34 included in the control section 7 shown in FIG. 1.

The following will explain the control section 7 of the present image forming apparatus in reference to FIG. 1. FIG. 1 is a block diagram showing an arrangement of the control section 7 of the present image forming apparatus.

The CPU 31 is a brain for controlling all the operations of the image forming apparatus. That is, the CPU 31 receives from an image information input section the image information transmitted from the terminal device and/or the image information read by the image scanning section 5. Then, the CPU 31 causes the image information processing section 34 to process the image information in accordance with instructions, such as a print condition, a print request, etc., supplied from an operating section, such as a condition input section, a display section, etc.

Then, the CPU 31 supplies the processed image information to a print processing section. Then, the CPU 31 controls the laser scanner unit, a print process control section for controlling the image forming section 2, a fixing control section for controlling the fixing section 3, a sheet ejection control section for controlling the sheet ejecting section 4, etc., and also causes a sheet conveyance control section to control a sheet conveying system, such as the sheet feeding section 1, the idle roller 16, etc. In this way, the image is formed on the sheet P having a predetermined size instructed. Moreover, the CPU 31 also causes an option processing section to control an option device, such as the automatic document conveying device 6, etc.

The image information processing section 34 includes, as an image processing section 36, (i) an input image processing section for carrying out a predetermined image processing with respect to the image information supplied through the image information input section and (ii) an output image processing section 38 for carrying out a predetermined image processing with respect to image data, processed by the input image processing section, so as to obtain output image data for forming a write image outputted to the print processing section. The image information processing section 34 further includes a printing ratio calculating section 35 for calculating a printing ratio on the basis of the output image data once processed by the output image processing section 38.

As a factor for predicting the occurrence of the image elongation, the CPU 31 uses a result of a calculation carried out by the printing ratio calculating section 35 (a function as the image elongation predicting section).

Moreover, the CPU 31 specifies the image elongation occurring area of the electrostatic latent image on the basis of the result of the calculation carried out by the printing ratio calculating section 35 (a function as the image elongation occurring area specifying section).

Further, on the basis of the result of the calculation carried out by the printing ratio calculating section 35 and a slipping ratio obtained in advance on the basis of the amount of the toner image lengthened on the sheet P due to the image elongation, the CPU 31 determines the amount of the image elongation occurring area to be shortened (a function as the shortening amount setting section).

Furthermore, in the case in which the occurrence of the image elongation is predicted, the CPU 31 causes the output image processing section 38 to carry out the image processing again to create the output image data so that the image elongation occurring area of the electrostatic latent image formed on the photoreceptor 21 is shortened in the direction in which the sheet is conveyed (a function as the image elongation correcting section).

The ROM 32 includes the functions of the image elongation predicting section, the image elongation occurring area specifying section, the image elongation correcting section and the shortening amount setting section, and stores various programs used by the CPU 31 for causing the present image forming apparatus to function and data, such as the number of steps of a motor, etc. The RAM 33 is a storage section (memory) used by the CPU 31.

The following will explain a prediction of the occurrence of the image elongation. As a result of diligent studies, the present inventors found that the slip phenomenon of the sheet P which phenomenon causes the image elongation closely relates to the printing ratio of a region on the sheet P which region passes through the transfer nip portion 27 while the bended portion 28 exists. The present inventors further found that it is possible to effectively predict the occurrence of the image elongation on the basis of the printing ratio of the above-described region of the sheet P.

Figures 6, 7:
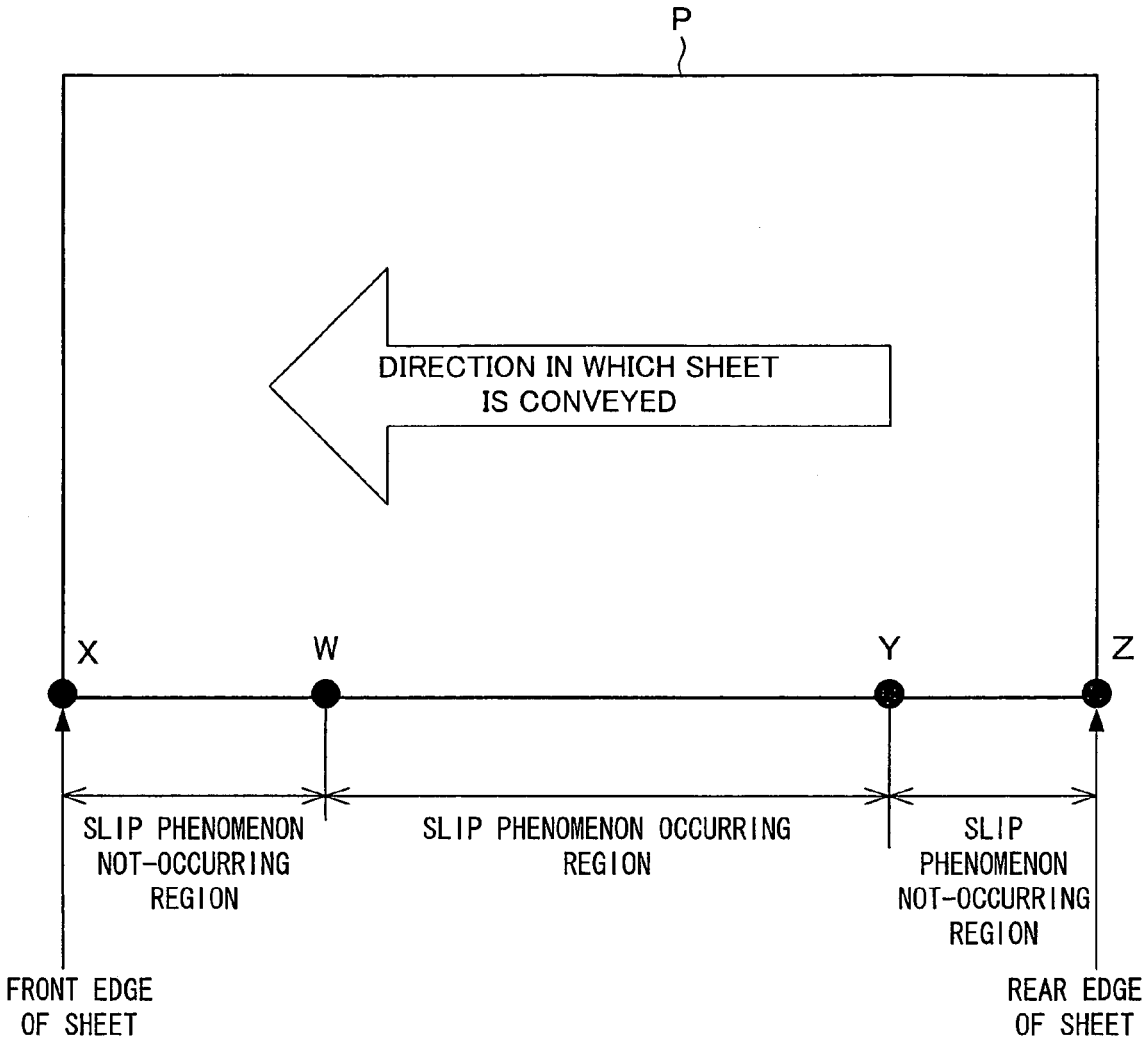
FIG. 6 is an explanatory diagram showing a slip phenomenon occurring region on a sheet used by the image forming apparatus, and the slip phenomenon occurring region is determined depending on a length of the sheet in a direction in which the sheet is conveyed.
FIG. 7 is an explanatory diagram showing a relation between a slipping ratio and a printing ratio, and the relation is used for, for example, predicting the occurrence of an image elongation.

The bended portion 28 disappears after the rear edge of the sheet P finishes passing through the idle roller 16. Therefore, as shown in FIG. 6, a certain region (Y-Z) which passes through the transfer nip portion 27 after the rear edge of the sheet P finishes passing through the idle roller 16 is a slip phenomenon not-occurring region where no slip phenomenon occurs no matter how high the printing ratio is. The length of this region in the direction in which the sheet is conveyed is substantially equal to the separation distance between the transfer nip portion 27 and the idle roller 16.

Moreover, it is empirically confirmed that a certain region (X-W) is also a region where no slip phenomenon occurs no matter how high the printing ratio is. This is because the bended portion 28 is not formed sufficiently. Therefore, the certain region (X-W) which passes through the transfer nip portion 27 before the bended portion 28 is sufficiently formed is also the slip phenomenon not-occurring region. Note that the slip phenomenon not-occurring region (X-W) at the front edge of the sheet varies depending on the differences in peripheral velocity between the photoreceptor 21 and the transfer roller 25 and between the photoreceptor 21 and the idle roller 16, the amount of the bended portion 28, etc.

In the present image forming apparatus, on the basis of a printing ratio of a slip phenomenon occurring region (W-Y) that is a region between the slip phenomenon not-occurring region (X-W) at the front edge of the sheet and the slip phenomenon not-occurring region (Y-Z) at the rear edge of the sheet, the CPU 31 predicts the occurrence of the image elongation, specifies the image elongation occurring area of the electrostatic latent image and obtains the amount of the image elongation occurring area to be shortened on the basis of the amount of the visible image lengthened due to the image elongation. The printing ratio calculating section 35 calculates the printing ratio of the sheet P to which the toner image is transferred on the basis of the image information, and the printing ratio of the slip phenomenon occurring region (W-Y) can be obtained from the printing ratio of the sheet P.

On the basis of the output image data processed by the output image processing section 38, the printing ratio calculating section 35 calculates the printing ratio per a plurality of scanning lines or per one scanning line. In the present image forming apparatus, the printing ratio calculating section 35 calculates the printing ratio per one line. As an example of a case in which the printing ratio calculating section 35 calculates the printing ratio per a plurality of scanning lines, the printing ratio can be obtained per a nip size (a size in the direction in which the sheet is conveyed) of the transfer nip portion 27. If the resolution is 600 Ddpi and the transfer nip is 2.5 mm, the printing ratio can be calculated per 60 sub-scanning lines.

The printing ratio of 60 sub-scanning lines can be obtained on the basis of the output image data by the following equation (1).

$$(\Sigma(\text{the total number of pixels in the image in 60 sub-scanning lines})/(\Sigma(\text{the total number of pixels in 60 sub-scanning lines}))\times 100\% \quad (1)$$

The total number of pixels in the image in 60 sub-scanning lines is the total number of valid pixels to which the toner is deposited (which form dots) in 60 sub-scanning lines. The total number of pixels in 60 sub-scanning lines is a value determined depending on the size of the sheet P in a main scanning direction (that is, in a direction orthogonal to the direction in which the sheet is conveyed). In the case in which the left edge void and/or the right edge void are provided, the pixels in these voids are included in the total number of pixels in 60 sub-scanning lines as invalid pixels to which the toner is not deposited (which do not form dots).

In the case of the color image forming apparatus which forms an image by, for example, four colors that are cyan, magenta, yellow and black, the printing ratio of each color is calculated, the printing ratios calculated are added, and the printing ratios added are averaged. That is, if the printing ratio is calculated for every 60 lines, in the case in which the printing ratios obtained for cyan, magenta, yellow and black by using the above equation (1) are Z1, Z2, Z3 and Z4, respectively, the printing ratio calculating section 35 carries out the addition of Z1, Z2, Z3 and Z4, and divides the sum of Z1, Z2, Z3 and Z4 by four that is the number of colors.

Then, for each sheet size (size in the direction in which the sheet is conveyed), the CPU 31 includes one relation between the printing ratio and the slipping ratio shown in, for example, FIG. 7 (the ROM 32 stores such relations). Here, the slipping ratio can be obtained in advance on the basis of the amount of the visible image lengthened due to the image elongation, and is a value obtained by (i) dividing the amount of the visible image lengthened by the length in the direction in which the sheet is conveyed and (ii) multiplying the value obtained by the division by 100.

The amount of the visible image lengthened can be obtained by repeatedly carrying out such test that the amount of the rear edge void reduced (that is, the amount of the image lengthened) is measured while variously changing a combination of the printing ratio and the sheet size (the size in the direction in which the sheet is conveyed). The sheet size is variously changed because the larger the sheet size is, the larger the total number of occurrences of the image elongation becomes. As a result, the total amount of the image lengthened (the amount of the rear edge moved backward) becomes large. That is, the larger the sheet size becomes, the larger in area the slip phenomenon occurring region becomes. Therefore, even if the printing ratio is low and the frequency of occurrence of the slip phenomenon is low (the amount of the image lengthened per unit length in the direction in which the sheet is conveyed is small), the rear edge of the image moves backward in the case in which the slip phenomenon occurring region is large in area.

In the present image forming apparatus, if no countermeasures are taken with respect to the image elongation caused due to the slipping phenomenon, the amount of the visible image lengthened is as follows for each printing ratio in the case of an A3 sheet (the length in the direction in which the sheet is conveyed is 420 mm). That is, the amount of the visible image lengthened is 0 mm when the printing ratio is in a range from 0% to 40%, 1.0 mm when the printing ratio is in a range from more than 40% to 60%, 2.0 mm when the printing ratio is in a range from more than 60% to 80%, and 3.0 mm when the printing ratio is in a range from more than 80% to 100%.

As shown in FIG. 7, the slipping ratio obtained on the basis of the amount of the visible image lengthened is 0.0% when the printing ratio is in a range from 0% to 40%, 0.238% when the printing ratio is in a range from more than 40% to 60%, 0.476% when the printing ratio is in a range from more than 60% to 80%, and 0.714% when the printing ratio is in a range from more than 80% to 100%.

The CPU 31 associates the image elongation occurring area with line position information that indicates the position of a line (for example, the printing ratio of an $A^{th}$ line is B %) so as to specify the image elongation occurring area on the basis of the printing ratio calculated per line by the printing ratio calculating section 35. For example, in the case in which the resolution of the printed image is 600 dpi, the number of lines of the A3 sheet (420 mm) in a main scanning direction is as follows.

$$420\ (\text{mm})/25.36\ (\text{mm})\times 600\ (\text{dpi})=9937$$

Using a specific example image, the following will explain procedures by which the CPU 31 predicts the occurrence of the image elongation, specifies the image elongation occurring area and determines the amount of the image elongation occurring area to be shortened on the basis of the printing ratio calculated.

Figure 8:
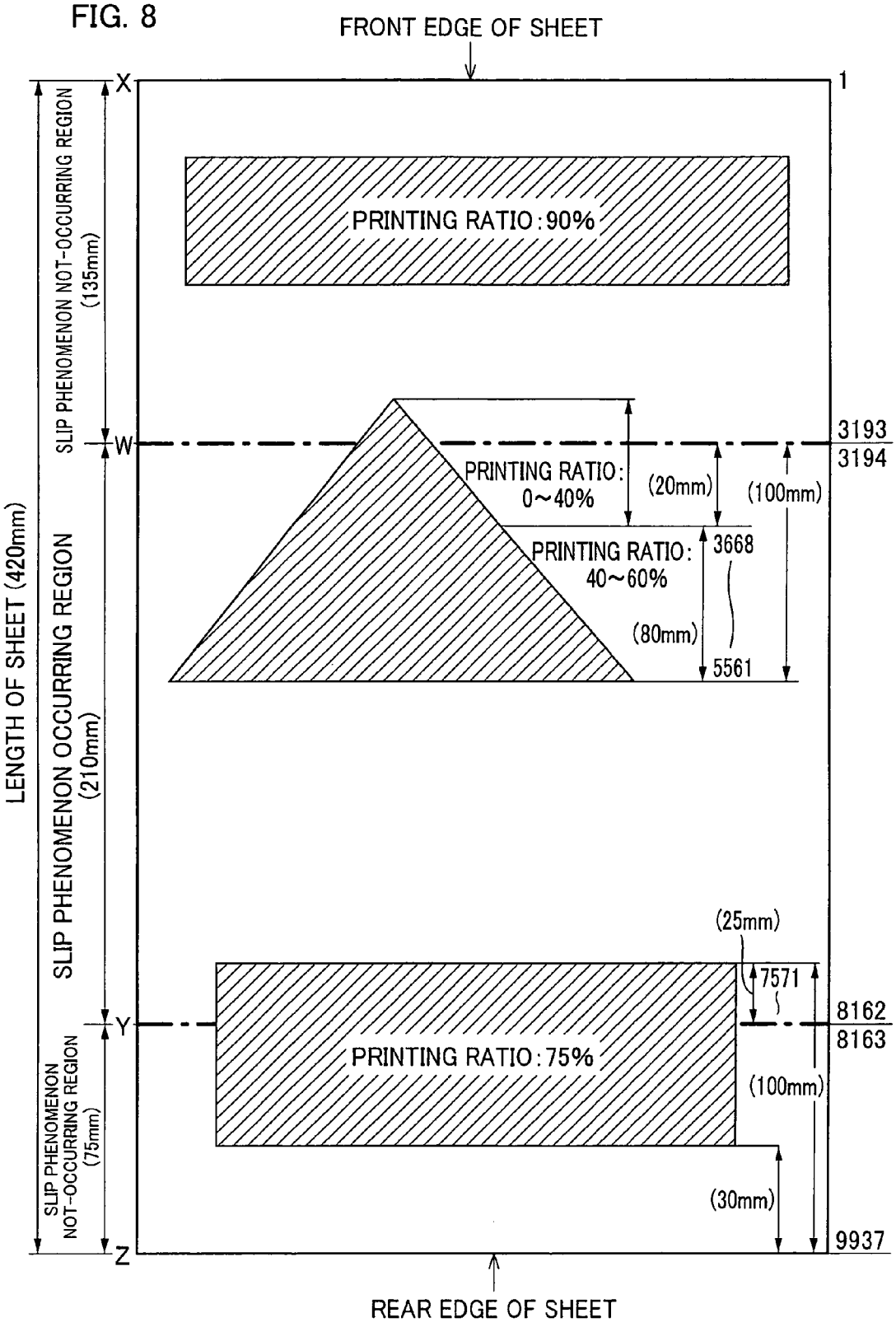
FIG. 8 is an explanatory diagram specifically showing, by using an example image, processes of predicting the occurrence of the image elongation, specifying an image elongation occurring area, and setting the amount of the image elongation occurring area to be shortened.

FIG. 8 shows the example image. As shown in FIG. 8, a first image D1, a second image D2 and a third image D3 are separately placed on an A3 sheet P from a front edge end to a rear edge end of the sheet P.

The printing ratio calculating section 35 calculates per line the printing ratios of 9,937 lines in the main scanning direction on the basis of the output image data which is subjected to the image processing by the output image processing section 38. As described above, since the slip phenomenon does not occur in the slip phenomenon not-occurring region (X-W) at the front edge of the sheet, it is possible to ignore the printing ratios of lines (between the front edge of the sheet and a predetermined line) in the slip phenomenon not-occurring region (X-W). In the present image forming apparatus, since the slip phenomenon not-occurring region (X-W) is a region from the front edge to 135 mm, the CPU 31 ignores the printing ratios in the region from the front edge to 135 mm, that is, the printing ratios of the lines that are from a first line to a $3{,}193^{rd}$ line. Therefore, the high printing ratio of 90% is obtained for each scanning line which forms the first image D1, however the CPU 31 does not judge that the image elongation occurs.

Similarly, it is possible to ignore the printing ratios of lines (between the rear edge of the sheet and a predetermined line) in the slip phenomenon not-occurring region (Y-Z) at the rear edge of the sheet. In the present image forming apparatus, since the slip phenomenon not-occurring region (Y-Z) is a region from the rear edge to 75 mm, the CPU 31 ignores the printing ratios in the region from the rear edge to 75 mm, that is, the printing ratios of the lines that are from a $9{,}937^{th}$ line to an $8{,}163^{rd}$ line. Therefore, the high printing ratio of 75% is obtained for each scanning line which forms part of the third image D3 which part is in the slip phenomenon not-occurring region (Y-Z), however the CPU 31 does not judge that the image elongation occurs.

On the basis of the printing ratios of 4,968 lines (that are from a $3{,}194^{th}$ line to a $8{,}162^{nd}$ line) of the slip phenomenon occurring region (W-Y), the CPU 31 predicts the occurrence of the image elongation, specifies the image elongation occurring area and obtains the amount of the image elongation occurring area to be shortened.

In FIG. 8, except a front edge portion of the second image D2 (the printing ratios of lines in this front edge portion are from 0% to 40%), 1,893 lines that are from a $3{,}668^{th}$ line to a $5{,}561^{st}$ line (the distance between the $3{,}668^{th}$ line and the $5{,}561^{st}$ line is 80 mm) respectively have the printing ratios that are from more than 40% to 60%. Therefore, the amount of the visible image lengthened in the area of 1,893 lines can be calculated as follows.

$$1{,}893(\text{the number of lines})\times 0.238\ (\%)\approx 5(\text{the number of lines})$$

Thus, the present image forming apparatus predicts the occurrence of the image elongation of 5 lines. Then, 5 lines that is the amount of the visible image lengthened is used as the amount of the image elongation occurring area to be shortened, and the image is shortened by thinning out 5 lines from 1,893 lines that are from the $3{,}668^{th}$ line to the $5{,}561^{st}$ line.

Further, the printing ratios of 591 lines that are from a $7{,}571^{st}$ line to an $8162^{nd}$ line (the distance between the $7{,}571^{st}$ line and the $8162^{nd}$ line is 25 mm, and the area between the $7{,}571^{st}$ line and the $8162^{nd}$ line includes a part (close to the front edge portion of the sheet) of the third image D3) are 75%, respectively. Therefore, the amount of the visible image lengthened in the area of 591 lines can be calculated as follows.

$$591(\text{the number of lines})\times 0.476\ (\%)\approx 3(\text{the number of lines})$$

Thus, the present image forming apparatus predicts the occurrence of the image elongation of 3 lines. Then, 3 lines that is the amount of the visible image lengthened is used as the amount of the image elongation occurring area to be shortened, and the image is shortened by thinning out 3 lines from 591 lines that are from the $7{,}571^{st}$ line to the $8{,}162^{nd}$ line.

According to diligent studies by the present inventors, the frequency of occurrence of the slip phenomenon causing the image elongation changes depending on (i) the thickness of the sheet P, (ii) the smoothness of the sheet P and (iii) the humidity and temperature in the image forming apparatus (apparatus internal environment information), which (i), (ii) and (iii) are not adopted in the present image forming apparatus, though.

For example, as the thickness of the sheet P increases, the stiffness of the sheet P also increases. Therefore, the sheet P slips more, and the amount of the image lengthened also increases. Meanwhile, as the smoothness of the sheet P deteriorates, the surface of the sheet P becomes rough and uneven. Therefore, the toner moves as if the toner rolls on the uneven surface. That is, the sheet P easily slips, and the amount of the image lengthened becomes large.

Moreover, like the thickness of the sheet P, the temperature and humidity in the image forming apparatus change the stiffness of the sheet P. For example, the stiffness of the sheet P decreases (disappears) under conditions of high temperature and high humidity. Therefore, the sheet P hardly slips and the amount of the image lengthened becomes small. In contrast, the stiffness of the sheet P increases under conditions of low temperature and low humidity. Therefore, the sheet P easily slips and the amount of the image lengthened becomes large.

The CPU 31 includes the relations between the printing ratio and the slipping ratio (see FIG. 7), and one relation is prepared for one sheet size (the size in the direction in which the sheet is conveyed). However, one relation may be prepared for one combination of a certain sheet size and at least one of (i) the thickness of the sheet P, (ii) the surface smoothness of the sheet P and (iii) the apparatus internal environment information.

For example, as the relation prepared for the A3 sheet, the CPU 31 may include five types of relations, such as a relation for conditions of low temperature and low humidity, a relation for conditions of low temperature and normal humidity and conditions of normal temperature and low humidity, a relation for conditions of normal temperature and high humidity and conditions of high temperature and normal humidity, a relation for conditions of high temperature and high humidity and a relation for conditions of low temperature and high humidity and conditions of normal temperature and normal humidity.

FIG. 9 shows the relation for conditions of low temperature and low humidity. FIG. 10 shows the relation for conditions of low temperature and normal humidity and conditions of normal temperature and low humidity. FIG. 11 shows the relation for conditions of normal temperature and high humidity and conditions of high temperature and normal humidity. FIG. 12 shows the relation for conditions of high temperature and high humidity. Note that the relation shown in FIG. 7 may be used for conditions of low temperature and high humidity, conditions of normal temperature and normal humidity and conditions of high temperature and low humidity.

Note that the low temperature is equal to or higher than 5° C. and lower than 15° C., the normal temperature is equal to or higher than 15° C. and lower than 25° C. and the high temperature is equal to or higher than 25° C. and lower than 35° C. Moreover, the low humidity is equal to or higher than 10% and lower than 40%, the normal humidity is equal to or higher than 40% and lower than 70% and the high humidity is equal to or higher than 70% and lower than 90%.

Moreover, (i) one relation between the printing ratio and the slipping ratio may be prepared for one sheet size, and (ii) whether or not a process for shortening the image on the basis of a sequence of steps of, on the basis of the relation, predicting the image elongation, specifying the image elongation occurring area and calculating the amount of the image elongation occurring area lengthened is carried out may be determined depending on the thickness of the sheet P, the surface smoothness of the sheet P and the humidity and temperature in the image forming apparatus (apparatus internal environment information). Further, (i) one relation may be prepared for one sheet size, (ii) the relation between the printing ratio and the slipping ratio may be corrected in accordance with the thickness of the sheet P, the surface smoothness of the sheet P and the humidity and temperature in the image forming apparatus (apparatus internal environment information), and (iii)

the above-described sequence of steps may be carried out on the basis of the relation corrected.

As described above, on the basis of the amount of the image elongation occurring area to be shortened, the CPU 31 causes the output image processing section 38 to carry out the image processing again to create final output image data so that the image on the image elongation occurring area is shortened.

As a method for shortening the image, it is possible to use a common method for shortening the image in the direction in which the sheet is conveyed. On the basis of the slipping ratio, the image elongation occurring area may be magnified independently, that is, the image elongation occurring area may be changed in size at a certain magnification in the main scanning direction and changed in size at a magnification different from the aforementioned certain magnification in the sub scanning direction. Here, the size of the image remains the same (100%) in the main scanning direction but is shortened in the direction in which the sheet is conveyed (in the sub scanning direction). The image shortened on the basis of the slipping ratio is subjected to the image processing to obtain a write image, and the write image is formed on the photoreceptor to obtain the electrostatic latent image (toner image) which can deal with the slip phenomenon of the sheet P.

As another method for shortening the image, it is possible to thin out the main scanning line(s) to shorten the image in the direction in which the sheet is conveyed. In this case, data of the line(s) to be thinned out is deleted on the basis of the output image data used for calculating the printing ratio by the printing ratio calculating section 35. In this way, the final output image data can be obtained. Unlike the method for independently magnifying the image, it is unnecessary to carry out the image processing again by the output image processing section 38. Therefore, it is possible to reduce time required.

FIGS. 13(*a*) and 13(*b*) show how to thin out the main scanning line(s). Basically, a line is thinned out in the case in which the line has the same printing ratio as lines provided at both sides of the line.

Here, consider the case in which the line(s) are thinned out from 14 lines that are from an $n^{th}$ line to an $(n+13)^{th}$ line. In FIG. 13(*a*), the lines having the same pattern have the same printing ratio. That is, the $n^{th}$ line and an $(n+1)^{th}$ line have the same printing ratio, an $(n+2)^{th}$ line to an $(n+5)^{th}$ line have the same printing ratio, an $(n+6)^{th}$ line to an $(n+10)^{th}$ line have the same printing ratio, and an $(n+11)^{th}$ line to the $(n+13)^{th}$ line have the same printing ratio.

FIG. 13(*b*) shows (i) whether or not each of these 14 lines can be thinned out and (ii) its reason for each line. The line having the same printing ratio as two lines provided at both sides of the line is the $(n+3)^{th}$ line, the $(n+7)^{th}$ line and the $(n+9)^{th}$ line. Therefore, these three lines are target lines to be thinned out. Note that the $(n+8)^{th}$ line is not the target line. This is because, as shown in REASONS FOR YES AND NO in FIG. 13(*b*), the image is shortened too much if two or more consecutive lines are thinned out. On this account, the line(s) adjacent to the line to be thinned out will not be the target line(s).

Then, the number of lines to be thinned out is adjusted as follows so as to be equal to the number of lines obtained by the CPU 31 as the amount of the image elongation occurring area to be shortened.

(1) In the case in which the number of target lines to be thinned out is larger than the number of lines as the amount of the image elongation occurring area to be shortened Give a number (1, 2, 3, . . . ) to each target line. Thin out some target lines at an interval of a value obtained by dividing the number of target lines by the number of lines as the amount of the image elongation occurring area to be shortened. In this way, decrease the number of target lines so that the number of target lines becomes equal to the number of lines as the amount of the image elongation occurring area to be shortened.

Example

In the case in which the number of target lines to be thinned out is 15 and the number of lines as the amount of the image elongation occurring area to be shortened is 5, the number of target lines to be thinned out is larger by 10. Therefore, five target lines (2, 5, 8, 11 and 14) are selected from 15 target lines at an interval of 3 obtained by dividing 15 (the number of target lines to be thinned out) by 5 (the number of lines as the amount of the image elongation occurring are to be shortened). On the basis of this, the final output image data is created.

(2) In the case in which the number of lines as the amount of the image elongation occurring area to be shortened is larger than the number of target lines to be thinned out Find a line (or lines) whose printing ratio and each printing ratio of lines provided at both sides of the line are the most similar with each other. Add the line (or the lines) to the target lines as the target line. In this way, increase the number of target lines so that the number of target lines becomes equal to the number of lines as the amount of the image elongation occurring area to be shortened.

Example

In the case in which the number of target lines to be thinned out is 3 and the number of lines as the amount of the image elongation occurring area to be shortened is 5, the number of target lines is smaller by 2. In this case, it is necessary to find, from all the lines constituting the region to be shortened, two lines each of whose printing ratio and each printing ratio of lines provided at both sides of the line are the most similar with each other. By adding these two lines as the target line, 5 target lines are secured. On the basis of this, the final output image data is created.

Figure 14:
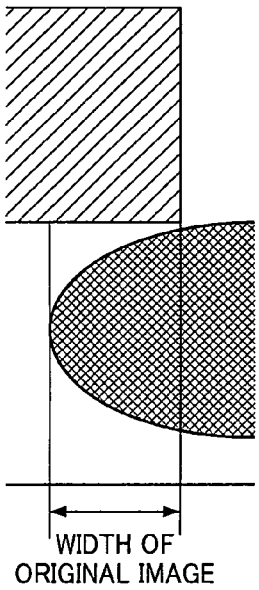
FIGS. 14(*a*) to 14(*d*) are explanatory diagrams showing how the image elongation caused due to a slip phenomenon is corrected.
Figure 14:
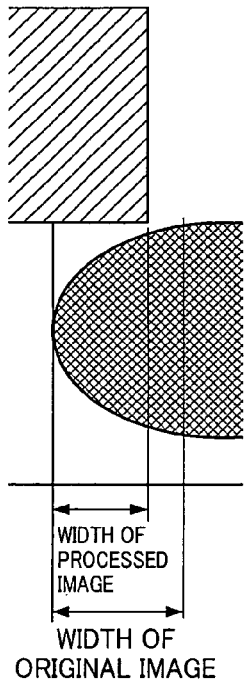
Figure 14:
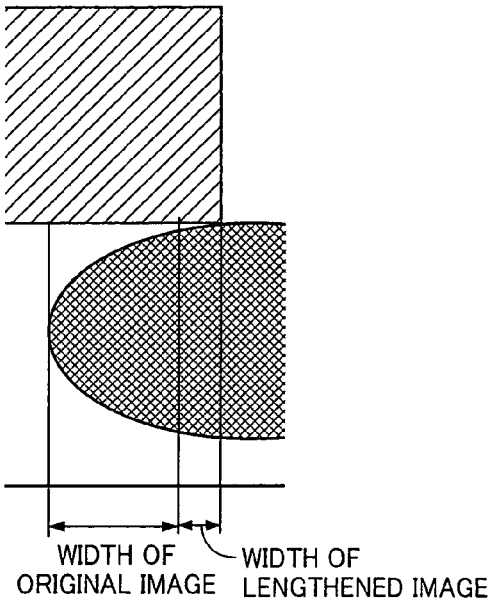
Figure 14:
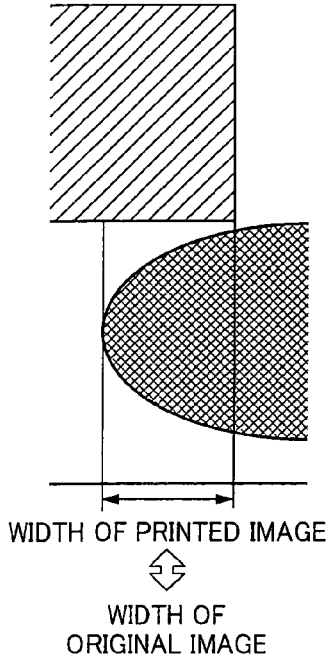

FIGS. 14(*a*) to 14(*d*) show how the image elongation caused due to the slip phenomenon is corrected by the above-described countermeasures. FIG. 14(*a*) shows the original image, and FIG. 14(*b*) shows the write image whose image elongation occurring area is shortened. In the write image, the width of a region where the printing ratios are high is shortened as compared with the width of the original image. If the original image itself is transferred to the sheet P as the write image without considering the image elongation caused due to the slip phenomenon, the width of the region where the printing ratio is high is lengthened as compared with the width of the original image as shown in FIG. 14(*b*). In contrast, if the write image (see FIG. 14(*c*)) whose image elongation occurring area is shortened is transferred to the sheet P, as shown in FIG. 14(*d*), the width of the image on the sheet P becomes the same (substantially the same) as that of the original image in FIG. 14(*a*). Note that this example deals with a case in which the original image is outputted to the same-size sheet at the same magnification.

Figure 15:
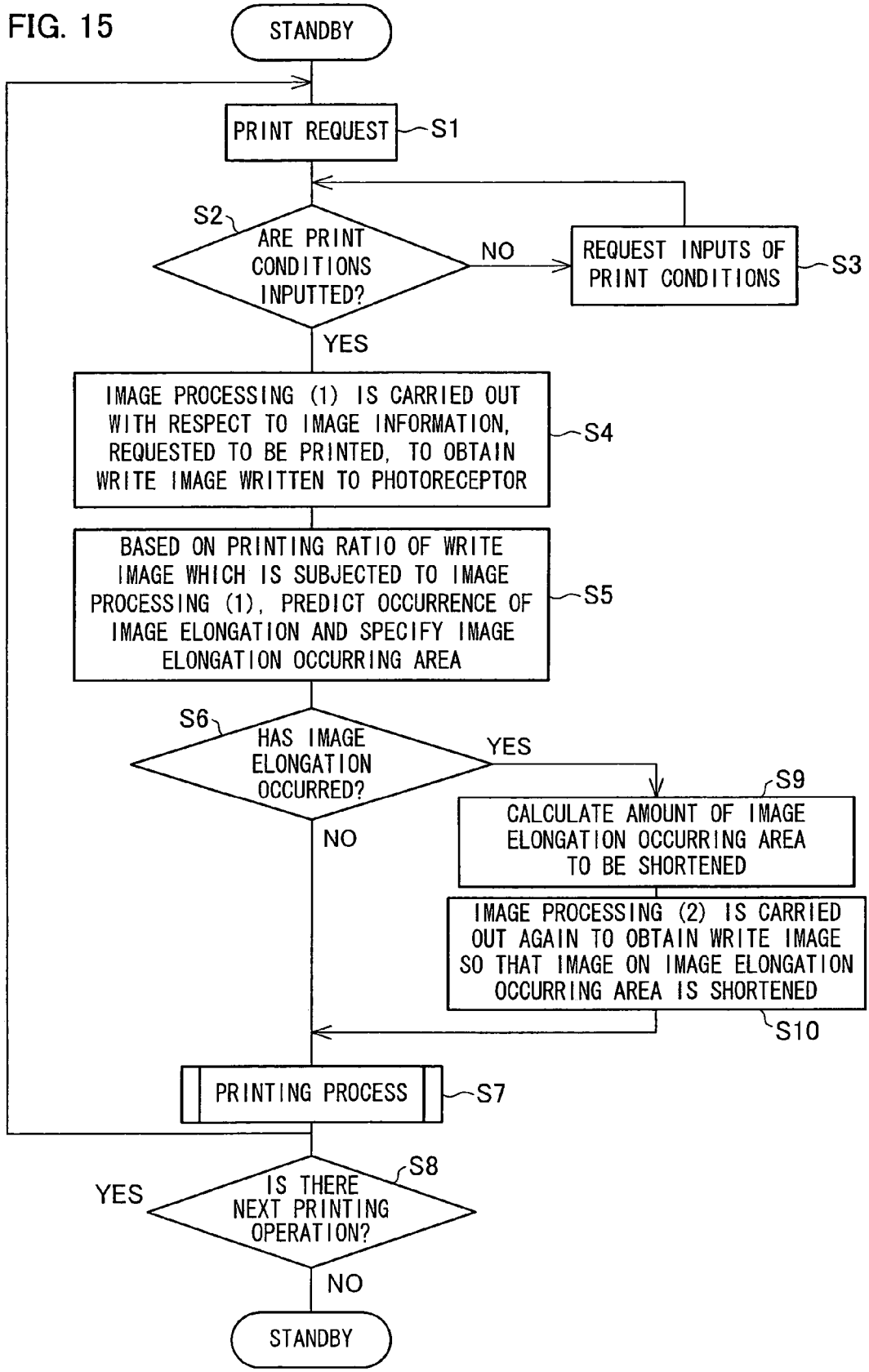
FIG. 15 is a flow chart showing steps for carrying out a printing by the image forming apparatus.
Figure 16:
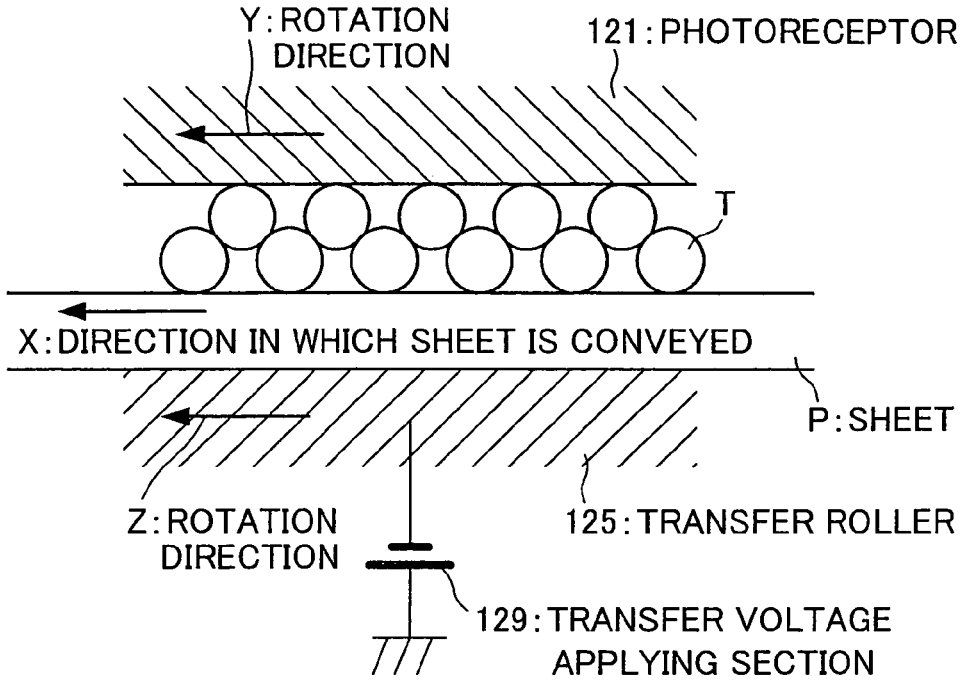
FIGS. 16(*a*) and 16(*b*) are explanatory diagrams showing a mechanism of a decrease in an absorptive power between a photoreceptor and a sheet, and the decrease is caused due to a decrease in particle diameter of a toner.
Figure 16:
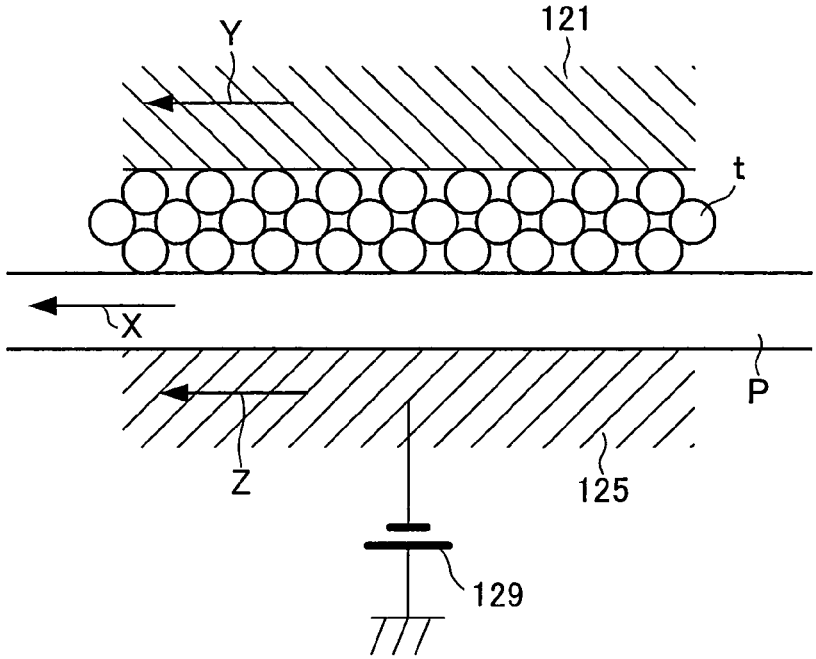
Figure 17:
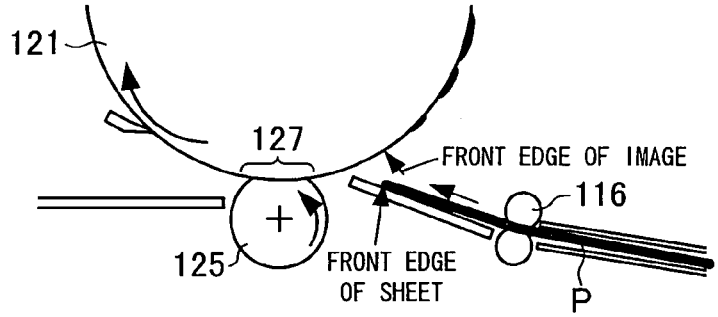
FIGS. 17(*a*) to 17(*d*) are explanatory diagrams showing how a sheet is conveyed to a transfer nip portion of a conventional image forming apparatus.
Figure 17:
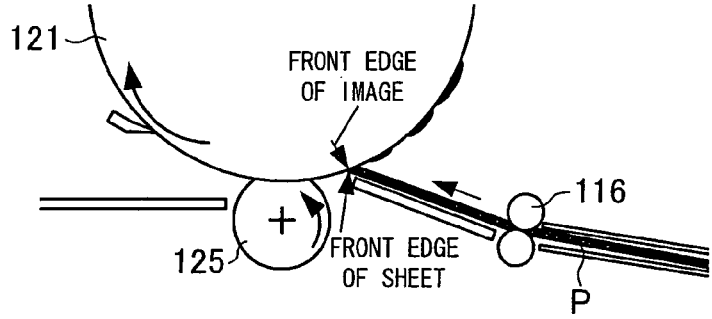
Figure 17:
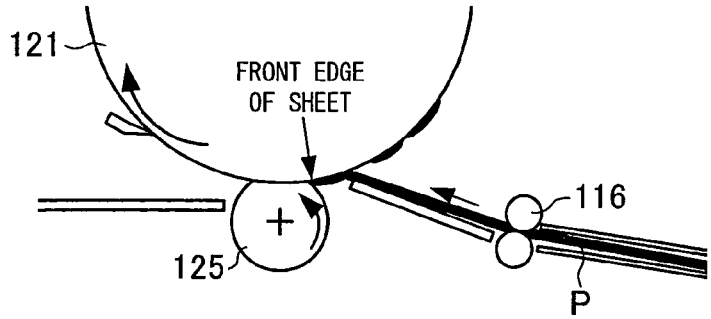
Figure 17:
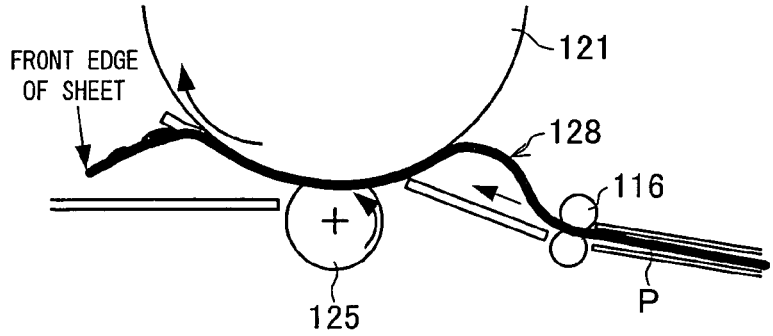

The following will explain image-forming operations carried out by the present image forming apparatus arranged as above in reference to a flow chart of FIG. 15.

After the print request is supplied to the present image forming apparatus that is in a standby state (S1) and print conditions are inputted, the CPU 31 checks necessary print conditions (S2). If the necessary print conditions are not inputted, the CPU 31 requests the input of the necessary print conditions (S3).

The print conditions to be checked here are, for example, (i) the sheet size of the sheet used for printing, (ii) whether the printing is the one-side printing or the two-side printing, (iii) an image density and (iv) print magnification, which (iii) and (iv) are necessary for calculating the printing ratio in a state in which the image based on the image information requested to be printed is formed on the sheet P.

After the CPU 31 checks the inputs of the necessary print conditions, the CPU 31 carries out an image processing (1) with respect to the image information on the basis of the specified sheet size, print magnification, etc. so as to obtain the write image (S4). In this image processing (1), the original image is used as is. Then, the printing ratio calculating section 35 calculates the printing ratio on the basis of the write image which is subjected to the image processing (1).

Next, on the basis of the write image which is subjected to the image processing (1), the CPU 31 predicts the occurrence of the image elongation, specifies the image elongation occurring area and calculates the amount of the image elongation occurring area to be shortened (S5).

In S6, the CPU 31 judges whether or not the image elongation occurs. In the case in which the image elongation does not occur, a printing process is carried out by using as is the write image obtained in S4 (S7). Then, the CPU 31 checks whether there is a next printing operation or not (S8). If there is the next printing operation, the process returns to S1. If there is no next printing operation, the image forming apparatus enters the standby state.

Meanwhile, if the CPU 31 predicts in S6 that the image elongation occurs, the CPU 31 again carries out an image processing (2) so as to obtain the write image whose image elongation occurring area is shortened in the direction in which the sheet is conveyed (S9, S10). Note that the main scanning line(s) may be thinned out here.

In S7, the write image obtained in S10 is used to carry out the printing process. Then, the CPU 31 checks whether there is a next printing operation or not (S8). If there is the next printing operation, the process returns to S1. If there is no next printing operation, the image forming apparatus enters the standby state.

As above, the present image forming apparatus predicts in advance the occurrence of a phenomenon in which the image is lengthened on the sheet P due to slipping of the sheet P, and shortens in advance the image elongation occurring area of the electrostatic latent image (write image). Therefore, even if the image elongation occurs, it is possible to reproduce an image that is substantially the same (similar to) the original image as if no image elongation had occurred. Moreover, since the rear edge void is secured, it is possible to avoid the above-described problems caused due to the reduction or disappearance of the rear edge void. In addition, it is possible to express the original image entirely.

Moreover, each of the image elongation predicting means, the image elongation occurring area specifying means, the image elongation correcting means and the shortening amount setting means in the image forming apparatus may be realized by a hardware logic or, as described in the present embodiment, a software using a CPU.

That is, the present image forming apparatus includes: a CPU (central processing unit) which executes a command of a control program for realizing functions of the image elongation predicting means, the image elongation occurring area specifying means, the image elongation correcting means and the shortening amount setting means; a ROM (read only memory) which stores the program; a RAM (random access memory) which loads the program; a storage device (recording medium), such as a memory, which stores the program and various data; and the like. Then, the image forming apparatus can be realized by supplying a computer-readable recording medium to an image scanner apparatus and then causing its computer (CPU, MPU, or the like) to read out and execute a program code recorded in the recording medium. Note that the computer-readable recording medium records therein the program code (executable format program, intermediate code program, source program) of the control program which realizes the above-described functions. In this case, the program code itself read out from the recording medium realizes the above-described functions.

Thus, in the present specification, means (section) does not necessarily mean a physical means, that is, the function(s) of each means may be realized by software. Moreover, the function(s) of a single means may be realized by two physical means or more, and the functions of two means or more may be realized by a single physical means.

Note that in the present embodiment, the recording medium may be a memory (not shown) for process steps on a microcomputer. For example, the program medium may be something like a ROM. Alternatively, the program medium may be such that a program reader device (not shown) as an external storage device may be provided in which a storage medium is inserted for reading.

In any case, the stored program may be executable on access by a microprocessor. Further, the program may be retrieved, and the retrieved program may be downloaded to a program storage area (not shown) in a microcomputer to execute the program. The download program is stored in a main body device in advance.

The program medium may be a recording medium constructed separably from a main body. The medium may be (i) tape based, such as a magnetic tape or cassette tape, (ii) disc based, such as a magnetic disc (floppy disc, hard disk, etc.) and an optical disc (CD-ROM, MO, MD, DVD, etc.), (iii) card based, such as an IC card (including a memory card) and an optical card, (iv) or a semiconductor memory, such as a mask ROM, EPROM (Erasable Programmable Read Only Memory), EEPROM (Electrically Erasable Programmable Read Only Memory), and a flash ROM. All these types of media hold the program in a fixed manner.

Moreover, in the present embodiment, since the system is arranged to connect to the Internet or another communication network, the medium may be a storage medium which holds the program in a flowing manner so that the program can be downloaded over the communication network. Note that if the program is downloaded over a communication network in this manner, the download program may be stored in a main body device in advance or installed from another recording medium.

As above, an image forming apparatus forms on an electrostatic latent image bearing member an electrostatic latent image based on image information, visualizes the electrostatic latent image by a developer so as to obtain a visible image, and causes a transfer device to transfer the visible image to a recording material at a transfer nip portion a while conveying the recording material, and the image forming apparatus includes: image elongation predicting means (image elongation predicting section) for predicting the occurrence of an image elongation, in other words, predicting that, due to slipping of the recording material with respect to the electrostatic latent image bearing member at the transfer nip portion, the visible image transferred is lengthened in a direction in which the recording material is conveyed; image elongation occurring area specifying means (image elongation occurring area specifying section) for specifying an image elongation occurring area of the electrostatic latent image, the image elongation occurring area being an area having such a possibility that the image elongation occurs; and image elongation correcting means (image elongation correcting section) for, if the image elongation predicting means predicts that the image elongation occurs, shortening the image elongation occurring area of the electrostatic latent image in the direction in which the recording material is conveyed, the image elongation occurring area being specified by the image elongation occurring area specifying means.

According to the above, the image elongation predicting means predicts the occurrence of the image elongation, in other words, predicts that, due to the slipping of the recording material with respect to the electrostatic latent image bearing member at the transfer nip portion, the visible image transferred is lengthened in the direction in which the recording material is conveyed, and the image elongation occurring area specifying means specifies the image elongation occurring area. In the case in which the image elongation predicting means predicts the occurrence of the image elongation, (i) the image elongation correcting means shortens in the direction in which the recording material is conveyed, the image elongation occurring area of the electrostatic latent image to be formed on the electrostatic latent image bearing member, (ii) the electrostatic latent image whose image elongation occurring area is shortened in advance in the direction in which the recording material is conveyed is formed on the electrostatic latent image bearing member and (iii) this electrostatic latent image is developed and becomes the visible image.

Therefore, even if the slip phenomenon occurs, that is, the phenomenon of slipping of the recording material with respect to the electrostatic latent image bearing member at the transfer nip portion occurs, and the visible image transferred to the recording material is lengthened on the recording material, the blank space at the rear edge portion of the recording material is secured since the visible image itself formed on the electrostatic latent image bearing member is being shortened.

As a result, it is possible to appropriately avoid the problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

In addition, with regard to a shortening of the electrostatic latent image, the image elongation occurring area of the electrostatic latent image is shortened here. Therefore, it is possible to express the image on the recording material, without cutting the image at the rear edge portion of the recording material in order to secure the blank space at the rear edge portion of the recording material.

It is appropriate that the image forming apparatus be configured such that the transfer means includes a transfer roller which is provided in such a manner as to be compressed against the electrostatic latent image bearing member via the recording material, and an electric field whose polarity is opposite to a polarity of an electric charge of the developer is applied to the transfer roller. Moreover, it is appropriate that $V1<V2\approx V3$ (that is $V1<V2=V3$ ($V3$ ranges from $0.99\times V2$ to $1.012\times V2$)), where $V1$ (mm/sec) is a peripheral velocity of the electrostatic latent image bearing member, $V2$ (mm/sec) is a peripheral velocity of the transfer roller and $V3$ (mm/sec) is a peripheral velocity of a recording material conveying roller provided in front of the transfer nip portion. Further, it is appropriate that $V1\times1.005\leqq V2\approx V3\leqq V1\times1.03$.

That is, the phenomenon of slipping of the recording material with respect to the electrostatic latent image bearing member easily occurs in the case in which the configuration of the transfer means, and the peripheral velocities of the electrostatic latent image bearing member, the transfer roller and the recording material conveying roller are as above. Therefore, in such a case, it is more effective to adopt the present technology. Further, it is appropriate that the present technology be applied to a case in which the average particle diameter of a developer to be used is equal to or less than 7 Φμm (the diameter of the large particle is less than 10 Φμm).

The image forming apparatus further includes shortening amount setting means (shortening amount setting section) for setting the amount of the image elongation occurring area to be shortened, the amount being set on the basis of the amount of the visible image lengthened due to the image elongation, and the image elongation correcting means shortens the image elongation occurring area of the electrostatic latent image on the basis of the amount set by the shortening amount setting means.

According to the above, the shortening amount setting means sets the amount of the image elongation occurring area to be shortened, the amount being set on the basis of the amount of the visible image lengthened due to the image elongation, and the image elongation correcting means shortens the image elongation occurring area of the electrostatic latent image on the basis of the amount set by the shortening amount setting means.

Therefore, it is possible to secure the default amount of the blank space at the rear edge portion of the recording material, and also possible to express the original image based on the image information and having no image elongation, as if no image elongation had occurred.

Such shortening amount setting means can be easily realized by using a slipping ratio set in advance on the basis of the amount of the visible image lengthened due to the image elongation, the slipping ratio being set in accordance with a length of the recording material in the direction in which the recording material is conveyed and a printing ratio of the recording material to which the visible image is transferred.

Further, in such a case, it is preferable that the slipping ratio be set by further using at least one factor of the thickness of the recording material to which the visible image is transferred, the surface smoothness of the recording material to which the visible image is transferred, and the apparatus internal environment information including information of a humidity in the image forming apparatus.

The amount of the visible image lengthened due to the image elongation relates to the thickness of the recording material to which the visible image is transferred, the surface smoothness of the recording material to which the visible image is transferred, and the apparatus internal environment information including the information of the humidity in the image forming apparatus, respectively. Therefore, by reflecting the thickness of the recording material, the surface smoothness of the recording material and/or the apparatus internal environment information with respect to the slipping ratio, it is possible to appropriately set the amount of the image elongation occurring area to be shortened.

Moreover, the image forming apparatus can be configured so that: as a factor for predicting the occurrence of the image elongation, as a factor for specifying the image elongation occurring area or as a factor for setting the amount of the image elongation occurring area to be shortened, the image elongation predicting means, the image elongation occurring area specifying means or the shortening amount setting means uses a printing ratio of a slip phenomenon occurring region of the recording material to which the visible image is transferred; and the slip phenomenon occurring region is a region which has such a possibility that a phenomenon of slipping of the recording material with respect to the electrostatic latent image bearing member occurs, and whose length in the direction in which the recording material is conveyed is determined depending on a length of the recording material in the direction in which the recording material is conveyed, and the length is 0 or more.

The occurrence of the image elongation and the amount of the image lengthened due to the image elongation relate to a printing ratio of the slip phenomenon occurring region of the recording material to which the visible image is transferred. Here, the slip phenomenon occurring region is a region which has such a possibility that a phenomenon of slipping of the recording material with respect to the electrostatic latent image bearing member occurs, and whose length in the direction in which the recording material is conveyed is determined depending on a length of the recording material in the direction in which the recording material is conveyed, and the length is 0 or more. In the case in which the length of the recording material is short, the slip phenomenon occurring region does not exist.

Therefore, by using the printing ratio of the slip phenomenon occurring region as a factor for predicting the occurrence of the image elongation, as a factor for specifying the image elongation occurring area or as a factor for setting the amount of the image elongation occurring area to be shortened, it is possible to accurately and appropriately predict the occurrence of the image elongation, specify the image elongation occurring area or set the amount of the image elongation occurring area to be shortened.

Specifically, the slip phenomenon occurring region can be a region obtained by omitting from an entire region of the recording material, a region which passes through the transfer nip portion in a state in which the recording material is not in the recording material conveying roller, or a region obtained by omitting from an entire region of the recording material, a region which passes through the transfer nip portion in a state in which a bended portion of the recording material is not completely formed in front of the transfer nip portion.

Further, the image forming apparatus can be configured so that as a factor for predicting the occurrence of the image elongation, as a factor for specifying the image elongation occurring area or as a factor for setting the amount of the image elongation occurring area to be shortened, the image elongation predicting means, the image elongation occurring area specifying means or the shortening amount setting means further uses at least one of a thickness of the recording material to which the visible image is transferred, a surface smoothness of the recording material to which the visible image is transferred and apparatus internal environment information including information of a humidity in the image forming apparatus.

The occurrence of the image elongation and the amount of the image lengthened due to the image elongation relate to the thickness of the recording material to which the visible image is transferred, the surface smoothness of the recording material to which the visible image is transferred, and the apparatus internal environment information including the information of the humidity in the image forming apparatus, respectively. Therefore, by using the thickness of the recording material, the surface smoothness of the recording material, and/or the apparatus internal environment information as a factor for predicting the occurrence of the image elongation, as a factor for specifying the image elongation occurring area and/or as a factor for setting the amount of the image elongation occurring area to be shortened, it is possible to accurately and appropriately predict the occurrence of the image elongation, specify the image elongation occurring area or set the amount of the image elongation occurring area to be shortened.

Moreover, the image forming apparatus can be configured so that the image elongation correcting means carries out a process of thinning out lines in a main scanning direction perpendicular to the direction in which the recording material is conveyed, the process being carried out with respect to output image data obtained by processing the image information, and then the image elongation correcting means shortens the image elongation occurring area of the electrostatic latent image.

In the case of a method for independently magnifying the electrostatic latent image to shorten the electrostatic latent image in the direction in which the recording material is conveyed, the method requires an image processing carried out by the output image processing section which processes the image information to obtain the output image data for forming the electrostatic latent image. Since the image can be shortened by using the output image data processed by the output image processing section, it is possible to reduce the time required.

As above, a program for controlling the image forming apparatus is a control program which causes a computer to execute the image elongation predicting means, the image elongation occurring area specifying means, the image elongation correcting means and the shortening amount setting means. Therefore, it is possible to appropriately avoid the problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method. In addition, it is possible to cause a computer to realize the image forming apparatus, which apparatus can express the original image on the sheet without cutting the image at the rear edge portion of the recording material in order to secure the blank space at the rear edge portion of the recording material. On this account, the image forming apparatus can be general-purpose.

As above, a recording medium is a computer-readable recording medium recording the control program of the image forming apparatus. Therefore, it is possible to easily supply to a computer the control program of the image forming apparatus which can appropriately avoid the problems caused due to the reduction or disappearance of the blank space at the rear edge portion of the recording material and which can express the original image on the sheet without cutting the image at the rear edge portion of the recording material in order to secure the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

The embodiments and concrete examples of implementation discussed in the foregoing detailed explanation serve solely to illustrate the technical details, which should not be narrowly interpreted within the limits of such embodiments and concrete examples, but rather may be applied in many variations, provided such variations do not exceed the scope of the patent claims set forth below.

What is claimed is:

1. An image forming apparatus, comprising:

an electrostatic latent image bearing member on which an electrostatic latent image is formed based on image information of a document;

a developing device for visualizing the electrostatic latent image on the electrostatic latent image bearing member by a developer so as to obtain a visible image;

a transfer device for transferring the visible image to a recording material at a transfer nip portion while conveying the recording material;

image elongation predicting means for predicting an occurrence of an image elongation which occurs due to slipping of the recording material with respect to the electrostatic latent image bearing member at the transfer nip portion, and which causes the visible image transferred to the recording material to be lengthened in a direction in which the recording material is conveyed, said image elongation predicting means predicting the occurrence of the image elongation using a printing ratio for portions of the visible image that are within a slip phenomenon occurring region of the recording material to which the visible image is transferred, the slip phenomenon occurring region being a region which has a possibility that a phenomenon of slipping of the recording material with respect to the electrostatic latent image bearing member occurs, and whose length in the direction in which the recording material is conveyed is determined depending on the length of the recording material in the direction in which the recording material is conveyed, the length of the slip phenomenon occurring region being 0 or more;

image elongation occurring area specifying means for specifying an image elongation occurring area of the electrostatic latent image where there is a possibility that the image elongation could occur based on the printing ratio of the visible image;

image elongation correcting means for, if said image elongation predicting means predicts that image elongation could occur, shortening the image elongation occurring area of the electrostatic latent image in the direction in which the recording material is conveyed, the image elongation occurring area being specified by said image elongation occurring area specifying means; and shortening amount setting means for setting, on the basis of a slipping ratio, the amount of the image elongation occurring area of the electrostatic latent image to be shortened, the slipping ratio being set in advance on the basis of the amount that the visible image is predicted to be lengthened due to the image elongation, the slipping ratio being set in accordance with a length of the recording material in the direction in which the recording material is conveyed and a printing ratio of the image said image elongation correcting means shortening the image elongation occurring area of the electrostatic latent image on the basis of the amount set by said shortening amount setting means;

the shortening of the image elongation occurring area being carried out by:

(a) an image process for processing the electrostatic latent image in the image elongation occurring area so that a write image is obtained, the electrostatic latent image being shortened in the direction in which the recording material is conveyed on the basis of the slipping ratio; or (b) a process for removing, from lines in the image elongation occurring area and in a main scanning direction perpendicular to the direction in which the recording material is conveyed, a line having a same printing ratio as lines which are provided at both sides of the removed line, the process being carried out with respect to output image data obtained by processing the image information.

2. The image forming apparatus as set forth in claim 1, wherein:

the transfer device includes a transfer roller which is provided in such a manner as to be compressed against the electrostatic latent image bearing member via the recording material and which transfers the visible image to the recording material; and the transfer roller includes a transfer voltage applying section which applies a voltage whose polarity is opposite to a polarity of an electric charge of the developer.

3. The image forming apparatus as set forth in claim 2, further comprising:

a recording material conveying roller, provided in front of the transfer nip portion, for conveying the recording material to the transfer nip portion, the following relationship being satisfied, $$V1<V2=V3,$$

where V1 (mm/sec) is a peripheral velocity of the electrostatic latent image bearing member, V2 (mm/sec) is a peripheral velocity of the transfer roller and V3 (mm/sec) is a peripheral velocity of the recording material conveying roller provided in front of the transfer nip portion, and V3 ranging from 0.99×V2 to 1.012×V2.

4. The image forming apparatus as set forth in claim 3, wherein $$V1\times1.005\leqq V2=V3\leqq V1\times1.03.$$

5. The image forming apparatus as set forth in claim 1, wherein the slip phenomenon occurring region is a region obtained by omitting from an entire region of the recording material, a region which passes through the transfer nip portion in a state in which the recording material is not in the recording material conveying roller.

6. The image forming apparatus as set forth in claim 1, wherein the slip phenomenon occurring region is a region obtained by omitting from an entire region of the recording material, a region which passes through the transfer nip portion in a state in which a bended portion of the recording material is not completely formed in front of the transfer nip portion.

7. The image forming apparatus as set forth in claim 1, wherein:

said image elongation predicting means predicts the occurrence of the image elongation by further using at least one of a thickness of the recording material to which the visible image is transferred, a surface smoothness of the recording material to which the visible image is transferred and apparatus internal environment information including information of a humidity in the image forming apparatus said image elongation occurring area specifying means specifies the image elongation occurring area by further using at least one of the thickness of the recording material to which the visible image is transferred, the surface smoothness of the recording material to which the visible image is transferred, and the apparatus internal environment information including the information of the humidity in the image forming apparatus; and said shortening amount setting means sets the amount of the image elongation occurring area to be shortened, by further using at least one of the thickness of the recording material to which the visible image is transferred, the surface smoothness of the recording material to which the visible image is transferred, and the apparatus internal environment information including the information of the humidity in the image forming apparatus.

8. The image forming apparatus as set forth in claim 1, wherein the slipping ratio is set by further using at least one of a thickness of the recording material to which the visible image is transferred, a surface smoothness of the recording material to which the visible image is transferred, and apparatus internal environment information including information of a humidity in the image forming apparatus.

* * * * *